US006792927B2

(12) United States Patent
Kobayashi

(10) Patent No.: US 6,792,927 B2
(45) Date of Patent: Sep. 21, 2004

(54) FUEL INJECTION AMOUNT CONTROL APPARATUS AND METHOD OF INTERNAL COMBUSTION ENGINE

(75) Inventor: Daisuke Kobayashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/614,204

(22) Filed: Jul. 8, 2003

(65) Prior Publication Data

US 2004/0007211 A1 Jan. 15, 2004

(30) Foreign Application Priority Data

Jul. 10, 2002 (JP) ..... 2002-201569

(51) Int. Cl.[7] ..... F02D 41/14
(52) U.S. Cl. ..... 123/673; 123/480; 701/109
(58) Field of Search ..... 123/480, 673, 123/674, 675, 682, 696; 701/102–104, 109

(56) References Cited

U.S. PATENT DOCUMENTS 5,003,950 A * 4/1991 Kato et al. ..... 123/492
5,448,978 A * 9/1995 Hasegawa et al. ..... 123/480
6,014,955 A 1/2000 Hosotani et al. ..... 123/399

FOREIGN PATENT DOCUMENTS

JP A 10-220269 8/1998
JP B2 2830461 9/1998

* cited by examiner

*Primary Examiner*—Tony M. Argenbright
(74) *Attorney, Agent, or Firm*—Oliff & Berridge, PLC

(57) ABSTRACT

A fuel injection control apparatus of an internal combustion engine calculates a basic fuel injection amount according to a predicted in-cylinder intake air amount based on a predicted operating state quantity of the engine, calculates an actual in-cylinder intake air amount from the actual engine operating state quantity, and calculates a feedforward fuel injection amount by correcting an excess or shortage of fuel due to an error in the predicted in-cylinder intake air amount by using a feedforward correction amount. The control apparatus also calculates a feedback correction amount based on a detected air/fuel ratio and an air/fuel ratio of an air-fuel mixture determined by the feedforward fuel injection amount, and obtains a final fuel injection amount by correcting the feedforward fuel injection amount with the feedback correction amount.

20 Claims, 8 Drawing Sheets

FUEL INJECTION AMOUNT CONTROL APPARATUS AND METHOD OF INTERNAL COMBUSTION ENGINE

INCORPORATION BY REFERENCE

The disclosure of Japanese Patent Application No. 2002-201569 filed on Jul. 10, 2002, including the specification, drawings and abstract, is incorporated herein by reference in its entirety.

BACKGROUND OF THE INVENTION

1. Field of the Invention

The invention relates to apparatus and method for controlling a fuel injection amount of an internal combustion engine.

2. Description of Related Art

In an internal combustion engine of an electronically-controlled fuel injection type, fuel is supplied to each of cylinders of the engine through fuel injection immediately before the intake stroke of the cylinder or during the intake stroke. The cylinder to which the fuel needs to be supplied will be hereinafter referred to as "particular cylinder" or "fuel injection cylinder". During an operation of the engine, an amount of intake air that is drawn into the fuel injection cylinder during the intake stroke is initially calculated, and fuel is injected in an amount corresponding to the calculated intake air amount, by the time when a corresponding intake valve is closed at the end of the intake stroke (i.e., by a point of time when the intake valve shifts from an open state to a closed state) at the latest. Depending upon the case, the fuel is injected before the start of the intake stroke.

To enable the internal combustion engine to operate in the manner as described above, a control apparatus of an internal combustion engine as disclosed in, for example, U.S. Pat. No. 6,014,955 predicts an opening angle of a throttle valve as one of operating state quantities of the engine up to the time of closing of the intake valve of the fuel injection cylinder, and predicts an amount of intake air that will be present in the fuel injection cylinder at the time of closing of the intake valve, based on the predicted throttle opening and an air model that models the behavior of air in the intake system of the engine. The control apparatus then injects fuel into the cylinder in an amount corresponding to the predicted intake air amount.

The conventional control apparatus as described above may suffer from the following problem: if a difference (or estimation error) arises between the predicted intake air amount and the actual intake air amount, for example, due to a difference between the predicted throttle opening and the actual throttle opening, the fuel injection amount calculated by the control apparatus deviates from an appropriate value, and the air/fuel ratio fluctuates or deviates from a target value.

In the meantime, there is widely known a fuel injection amount control apparatus that controls the fuel injection amount in a feedback fashion. More specifically, in order that the air/fuel ratio of an air-fuel mixture introduced into the engine coincides with a target air/fuel ratio, the control apparatus uses an air/fuel ratio sensor provided in an exhaust passage of the engine to detect the air/fuel ratio of exhaust gas, and controls the fuel injection amount in a feedback manner depending upon a deviation of the detected air/fuel ratio from the target air/fuel ratio. This arrangement makes it possible to reduce a steady-state deviation of the air/fuel ratio of the air-fuel mixture from the target air/fuel ratio due to, for example, changes in the properties of fuel, variations in the performance of injectors resulting from manufacturing errors, and the like.

It is, however, to be noted that the air/fuel ratio measured by the air/fuel ratio sensor is the air/fuel ratio of exhaust gas that is emitted from the combustion chamber after combustion of an air-fuel mixture supplied to the engine in the past, and then reaches the air/fuel ratio sensor through the exhaust passage. Therefore, the feedback control involves a large wasteful time. Furthermore, if the feedback control utilizing the detected air/fuel ratio is designed to promptly compensate for fluctuations in the air/fuel ratio due to estimation errors in the predicted intake air amount, the feedback control gain needs to be increased. If the control gain is excessively large, the air/fuel ratio may undergo hunting.

SUMMARY OF THE INVENTION

It is therefore an object of the invention to provide fuel injection amount control apparatus and method of an internal combustion engine, which are able to promptly compensate for estimation errors in the intake air amount, while at the same time making use of the advantages of the feedback control, so that the air/fuel ratio of an air-fuel mixture supplied to the engine can be stably made equal to the target air/fuel ratio.

To accomplish the above and/or other object(s), a fuel injection amount control apparatus according to a first aspect of the invention includes a predicted in-cylinder intake air amount calculating unit B1, a basic fuel injection amount calculating unit B3, an actual in-cylinder intake air amount calculating unit B4, a feedfoward correction amount calculating unit (B5–B7), a feedforward fuel injection amount calculating unit A1, an air/fuel ratio sensor 69, a feedback correction amount calculating unit (B8–B11), a final fuel injection amount calculating unit A2 and a fuel injector 39, as shown in FIG. 2. The control apparatus injects a fuel having the calculated final fuel injection amount into a particular cylinder during a particular intake stroke.

The control apparatus including the above-indicated units calculates a predicted in-cylinder intake air amount (klfwd) based on a predicted operating state quantity of the engine, and calculates a basic fuel injection amount (finjb(k)) based on the predicted in-cylinder intake air amount. On the other hand, the control apparatus calculates an actual in-cylinder intake air amount (klcyl(k−1)) from the actual (confirmed) engine operating state quantity, and calculates a feedforward fuel injection amount (finjfwd(k)) by correcting an excess or shortage of fuel due to a difference between the predicted in-cylinder intake air amount and the actual in-cylinder intake air amount by using a feedforward correction amount (finjk(k)). Also, the control apparatus calculates a feedback correction amount (finjfb(k)) for reducing a deviation between the actual air/fuel ratio (abyfs) detected by the air/fuel ratio sensor and an air/fuel ratio of an air-fuel mixture that is determined by the feedforward fuel injection amount (finjfwd(k)), and obtains a final fuel injection amount (finjfinal(k)) by correcting the feedforward fuel injection amount by using the feedback correction amount. In the following, each of the above-indicated units will be described.

The predicted in-cylinder intake air amount calculating unit B1 predicts an operating state quantity of the engine to be established at a point of time ahead of the current point of time. For example, the engine operating state quantity is an opening angle of a throttle valve of the engine, or the like, which is required for predicting or estimating the intake air amount of the engine. The predicted in-cylinder intake air amount calculating unit then calculates the predicted in-cylinder intake air amount (klfwd) that is an amount of intake air drawn into the particular cylinder of the engine during the particular intake stroke, based on the predicted engine operating state quantity, at a point of time before completion of the particular intake stroke of the particular cylinder. Namely, this unit predicts, prior to completion of a certain intake stroke, an amount of intake air drawn in this intake stroke, based on a future engine operating state quantity.

The basic fuel injection amount calculating unit B3 calculates the basic fuel injection amount (finjb(k)) for achieving a target air/fuel ratio, based on the predicted in-cylinder intake air amount thus calculated and the target air/fuel ratio. For example, the basic fuel injection amount (finjb(k)) is calculated by dividing the predicted in-cylinder intake air amount (klfwd) by the target air/fuel ratio (abyfref).

The actual in-cylinder intake air amount calculating unit B4 calculates the actual in-cylinder intake air amount (klcyl (k−1)), which is an amount of intake air drawn into the particular cylinder during an intake stroke one cycle before the particular intake stroke of the particular cylinder. More specifically, at a point of time after the engine operating state quantity used by the predicted in-cylinder intake air amount calculating unit for calculating the predicted in-cylinder intake air amount with respect to the intake stroke one cycle before the particular intake stroke is confirmed, the actual in-cylinder intake air amount calculating unit calculates the amount of intake air drawn into the particular cylinder during the intake stroke one cycle before the particular intake stroke, as the actual in-cylinder intake air amount (klcyl(k−1)), based on the actual engine operating state quantity thus confirmed. Thus, the actual in-cylinder intake air amount (klcyl(k−1)) is calculated based on the confirmed engine operating state quantity (that includes no prediction/estimation error), thereby providing an accurate in-cylinder intake air amount.

The feedforward correction amount calculating unit (B5–B7) calculates the feedforward correction amount (finjk(k)) based on the predicted in-cylinder intake air amount for the intake stroke one cycle before the particular intake stroke and the actual in-cylinder intake air amount for the intake stroke one cycle before the particular intake stroke. The feedforward correction amount is determined so as to compensate for an excess or a shortage of the basic fuel injection amount for the intake stroke one cycle before the particular intake stroke, which excess or shortage is caused by a difference between the predicted in-cylinder intake air amount for the intake stroke one cycle before the particular intake stroke of the particular cylinder and the actual in-cylinder intake air amount for the intake stroke one cycle before the particular intake stroke.

The feedforward fuel injection amount calculating unit A1 calculates the feedforward fuel injection amount (finjfwd (k)) by correcting the basic fuel injection amount (finjb(k)) for the particular intake stroke of the particular cylinder by using the feedforward correction amount (finjk(k)).

The air/fuel ratio sensor 69 detects the air/fuel ratio (abyfs) of exhaust gas emitted from the engine. The feedback correction amount calculating unit (B8–B11) calculates the feedback correction amount (finjfb(k)) for reducing a deviation between the air/fuel ratio (abyfs) detected by the air/fuel ratio sensor and an air/fuel ratio (klcyl(k−N)/fc(k−N)) of an air-fuel mixture corresponding to the exhaust gas whose air/fuel ratio is detected by the air/fuel ratio sensor. The air/fuel ratio of the air-fuel mixture is determined based on the feedforward fuel injection amount (finjfwd) calculated by the feedforward fuel injection amount calculating unit with respect to a past intake stroke of the particular cylinder during which the air-fuel mixture was introduced into the cylinder. The feedback correction amount calculating unit calculates the feedback correction amount based on the air/fuel ratio of the above-described air-fuel mixture and the detected air/fuel ratio.

The final fuel injection amount calculating unit A2 calculates the final fuel injection amount (finjfinal(k)) by correcting the feedforward fuel injection amount (finjfwd(k)) calculated with respect to the particular intake stroke of the particular cylinder, by using the feedback correction amount (finjfb(k)). The fuel injector 39 injects a fuel having the final fuel injection amount into the particular cylinder during the particular intake stroke.

In the above manner, an excess or shortage of the basic fuel injection amount due to a prediction/estimation error in the intake air amount for the intake stroke one cycle before the particular intake stroke is promptly compensated for by the feedforward correction amount that reflects the prediction/estimation error, so that the corrected fuel injection amount can be used for the coming and subsequent intake strokes In other words, the feedforward system that calculates the feedforward fuel injection amount compensates for a deviation of the fuel injection amount that depends on prediction/estimation of the in-cylinder intake air amount, from an appropriate value thereof, without relying upon the air/fuel ratio detected by the air/fuel ratio sensor.

Also, the feedback correction amount is used for surely compensating for a steady-state deviation of the air/fuel ratio from the target air/fuel ratio due to, for example, changes in the properties of fuel and variations in the performance of the injectors. In other words, the feedback system that provides the feedback correction amount compensates for a steady-state excess or shortage of the feedforward fuel injection amount, by using the detected air/fuel ratio. Thus, when the engine is in a transient operating state, in particular, the feedback control performed based on the detected air/fuel ratio does not need to compensate for transient fluctuations in the air/fuel ratio due to prediction/estimation errors in the in-cylinder intake air amount. Therefore, the gain of the feedback control can be set small, resulting in stable air/fuel ratio control. Furthermore, the feedforward system and the feedback system of the fuel injection amount control apparatus are adapted to compensate for excesses or shortages of the fuel injection amount due to different factors, and therefore the controls of these systems do not interfere with each other, and are free from instability due to otherwise possible interference.

According to a second aspect of the invention, there is provided a fuel injection amount control apparatus which includes a predicted in-cylinder intake air amount calculating unit B1, a basic fuel injection amount calculating unit B3, a feedforward fuel injection amount calculating unit A1, a feedforward in-cylinder fuel amount calculating unit B6, an actual in-cylinder intake air amount calculating unit B4, a feedforward target in-cylinder fuel amount calculating unit B5, a feedforward correction amount calculating unit B7, an air/fuel ratio sensor 69, a sensor detected in-cylinder fuel amount calculating unit B8, a feedback correction amount calculating unit B11, a final fuel injection amount calculating unit A2, and a fuel injector 39. The control apparatus thus constructed injects a fuel having the calculated final fuel injection amount into a particular cylinder for a particular intake stroke.

The control apparatus including the above-indicated units calculates a predicted in-cylinder intake air amount (klfwd) based on a predicted operating state quantity of the engine, calculates a basic fuel injection amount (finjb(k)) based on the predicted in-cylinder intake air amount, and calculates a feedforward fuel injection amount (finjfwd(k)) by correcting the basic fuel injection amount by using a feedforward correction amount (finjk(k)). The control apparatus also calculates, as a calculated in-cylinder fuel amount fc(k−1), an amount of fuel that is supposed to be introduced into the particular cylinder on the assumption that fuel having the feedforward fuel injection amount was injected for an intake stroke one cycle before the particular intake stroke. The control apparatus further calculates an actual in-cylinder intake air amount (klcyl(k−1)) for the intake stroke one cycle before the particular stroke, from the actual (confirmed) engine state operating quantity, and calculates a feedforward target in-cylinder fuel amount (fcref(k−1)), which is an amount of fuel that should have been actually supplied to the particular cylinder, by, for example, dividing the actual in-cylinder intake air amount by the target air/fuel ratio (abyfref). Then, the control apparatus calculates the feedforward correction amount (finjk(k)) based on the calculated in-cylinder fuel amount and the feedforward target in-cylinder fuel amount.

On the other hand, the control apparatus detects the air/fuel ratio of the exhaust gas, and calculates a sensor detected in-cylinder fuel amount (fcsns(k−N)), based on the actual in-cylinder intake air amount (klcyl(k−N)) obtained when an air-fuel mixture that gives rise to the detected air/fuel ratio was introduced into the cylinder (namely, the actual in-cylinder intake air amount for an intake stroke a predetermined cycles before the particular intake stroke), and the detected air/fuel ratio (abyfs). The control apparatus then calculates a feedback correction amount (finjfb(k)) for reducing a deviation between the calculated in-cylinder fuel amount (fc(k−N)) calculated with respect to the intake stroke the predetermined number of cycles before the particular intake stroke, and the sensor detected in-cylinder fuel amount (fcsns(k−N)). The control apparatus then obtains a final fuel injection amount finjfinal(k) by correcting the feedforward fuel injection amount by using the feedback correction amount.

In the control apparatus as described above, too, an excess or shortage of the basic fuel injection amount due to a prediction/estimation error in the intake air amount for the intake stroke one cycle before the particular intake stroke is promptly compensated for by the feedforward correction amount that reflects the prediction/estimation error, so that the corrected fuel injection amount can be used for the coming and subsequent intake strokes. In other words, the feedforward system that calculates the feedforward fuel injection amount compensates for a deviation of the fuel injection amount that depends upon prediction/estimation of the in-cylinder intake air amount, from an appropriate value thereof, without relying upon the air/fuel ratio detected by the air/fuel ratio sensor.

Also, the feedback correction amount is determined based on a difference between the sensor detected in-cylinder fuel amount as an amount of fuel actually supplied to the particular cylinder for the intake stroke the predetermined number of cycles before the particular intake stroke, and the calculated in-cylinder fuel amount that should have been actually supplied for the intake stroke the predetermined number of cycles before the particular intake stroke. The thus determined feedback correction amount is used for surely compensating for a steady-state deviation of the air/fuel ratio from the target air/fuel ratio due to, for example, changes in the properties of fuel and variations in the performance of the injectors. In other words, the feedback system that provides the feedback correction amount compensates for a steady-state excess or shortage of the feedforward fuel injection amount, by using the detected air/fuel ratio.

Accordingly, when the engine is in a transient operating state, in particular, the feedback control performed based on the detected air/fuel ratio does not need to compensate for transient fluctuations in the air/fuel ratio due to prediction/estimation errors in the in-cylinder intake air amount. Therefore, the gain of the feedback control can be set small, resulting in stable air/fuel ratio control. Furthermore, the feedforward system and the feedback system of the fuel injection amount control apparatus are adapted to compensate for excesses or shortages of the fuel injection amount due to different factors, and therefore the controls of these systems do not interfere with each other, and are free from instability due to otherwise possible interference.

According to a third aspect of the invention, there is provided a fuel injection amount control apparatus which includes a predicted in-cylinder intake air amount calculating unit B1, a basic fuel injection amount calculating unit B3, a feedforward fuel injection amount calculating unit A1, a feedforward in-cylinder fuel amount calculating unit B6, an actual in-cylinder intake air amount calculating unit B4, a feedforward target in-cylinder fuel amount calculating unit B5, a feedforward correction amount calculating unit B7, an air/fuel ratio sensor 69, a feedback correction amount calculating unit B11, a final fuel injection amount calculating unit A2 and a fuel injector 39. The control apparatus thus constructed injects fuel having the calculated final fuel injection amount into a particular cylinder for a particular intake stroke.

The control apparatus calculates various amounts, except a feedback correction amount, in similar manners to the fuel injection amount control apparatus according to the first or second aspect of the invention. Thus, the feedback correction amount calculating unit of the control apparatus will be described. The feedback correction amount calculating unit calculates a feedback correction amount finjfb(k) for reducing a deviation between a calculated air/fuel ratio (=klcyl(k−N)/fc(k−N)) and the air/fuel ratio (abyfs) detected by the air/fuel ratio sensor, based on the calculated air/fuel ratio and the detected air/fuel ratio. The calculated air/fuel ratio is determined based on the actual in-cylinder intake air amount (klcyl(k−N)) obtained when an air-fuel mixture that gives rise to the air/fuel ratio detected by the air/fuel ratio sensor 69 was introduced into the cylinder (namely, the actual in-cylinder intake air amount for an intake stroke a predetermined number of cycles before the particular intake stroke of the particular cylinder), and a calculated in-cylinder fuel amount fc(k−N) calculated by the feedforward in-cylinder fuel amount calculating unit with respect to the intake stroke the predetermined number of cycles before the particular intake stroke. The feedback correction amount calculating unit calculates the feedback correction amount so that the air/fuel ratio calculated by the feedforward system and the detected air/fuel ratio become equal to each other.

In the fuel injection amount control apparatus according to the third aspect of the invention, too, an excess or shortage of the basic fuel injection amount due to a prediction/estimation error in the intake air amount for the intake stroke one cycle before the particular intake stroke is promptly compensated for by the feedforward correction amount, so that the corrected fuel injection amount can be used for the coming and subsequent intake strokes. Also, the feedback correction amount is used for compensating for a steady-state deviation of the air/fuel ratio from the target air/fuel ratio due to, for example, changes in the properties of fuel and variations in the performance of the injectors.

Accordingly, when the engine is in a transient operating state, in particular, the feedback control performed based on the detected air/fuel ratio does not need to compensate for transient fluctuations in the air/fuel ratio due to prediction/estimation errors in the in-cylinder intake air amount. Therefore, the gain of the feedback control can be set small, resulting in stable air/fuel ratio control. Furthermore, the feedforward system and the feedback system of the fuel injection amount control apparatus are adapted to compensate for excesses or shortages of the fuel injection amount due to different factors, and therefore the controls of these systems do not interfere with each other, and are free from instability due to otherwise possible interference.

In the fuel injection amount control apparatuses as described above, the feedforward in-cylinder fuel amount calculating unit is preferably arranged to calculate the calculated in-cylinder fuel amount by using a forward model of a fuel behavior model representing the behavior of fuel deposited on a member that forms an intake passage of the engine. Also, the basic fuel injection amount calculating unit is preferably arranged to calculate the basic fuel injection amount by using an inverse model of a fuel behavior model representing the behavior of fuel deposited on a member that forms the intake passage of the engine.

With the above arrangements, the amount of fuel deposited on a member or members that form or define the intake passage is taken into consideration, and therefore the final fuel injection amount is calculated with further improved accuracy, thus making it possible to make the air/fuel ratio of the engine closer to or substantially equal to the target air/fuel ratio.

BRIEF DESCRIPTION OF THE DRAWINGS

The foregoing and/or further objects, features and advantages of the invention will become more apparent from the following description of an exemplary embodiment with reference to the accompanying drawings, in which like numerals are used to represent like elements and wherein.

DETAILED DESCRIPTION OF EXEMPLARY EMBODIMENTS

Figure 1:
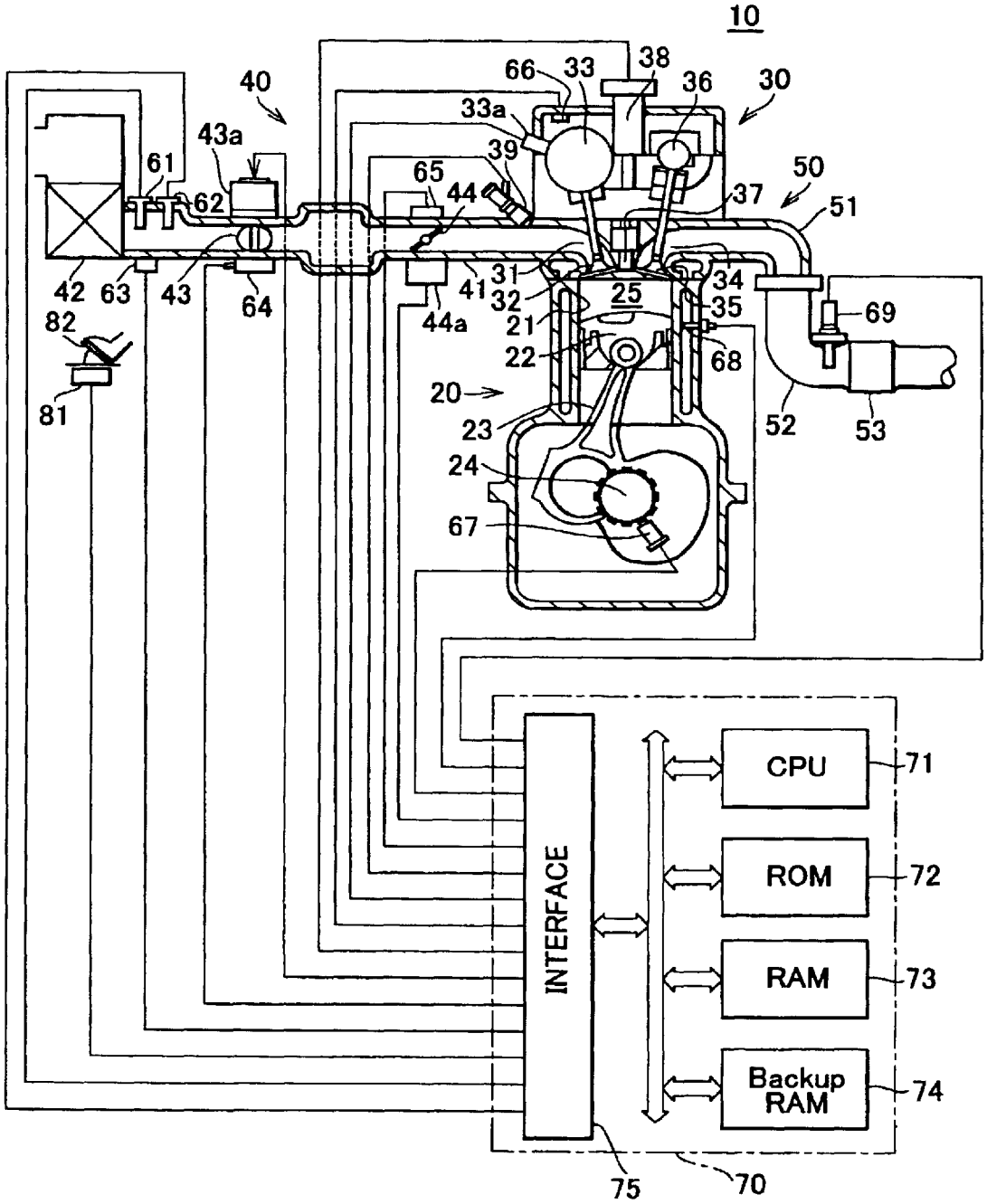
FIG. 1 is a view schematically showing a system in which a fuel injection amount control apparatus according to one embodiment of the invention is applied to a spark ignition type multi-cylinder internal combustion engine.

A fuel injection amount control apparatus of an internal combustion engine as an exemplary embodiment of the invention will be described with reference to the accompanying drawings. FIG. 1 schematically shows the construction of a system in which the fuel injection amount control apparatus of the exemplary embodiment is applied to a multi-cylinder (four-cylinder) internal combustion engine 10 of spark ignition type. While FIG. 1 shows one of the four cylinders and constituent components or members associated with the cylinder, the other cylinders have substantially the same structure as the illustrated cylinder.

The internal combustion engine 10 includes a cylinder block section 20 including a cylinder block, a cylinder block lower case, an oil pan and other components, a cylinder head section 30 fixed to the top of the cylinder block section 20, an intake system 40 for supplying a mixture of air and gasoline to the cylinder block section 20, and an exhaust system 50 for discharging exhaust gas from the cylinder block section 20 to the outside of the engine 10.

The cylinder block section 20 includes a cylinder 21, a piston 22, a connecting rod 23 and a crankshaft 24. The piston 22 moves up and down within the cylinder 21, and the reciprocating movement of the piston 22 is transmitted to the crankshaft 24 via the connecting rod 23, so that the crankshaft 24 is rotated. Head portions of the cylinder 21 and the piston 22 cooperate with the cylinder head section 30 to form a combustion chamber 25.

The cylinder head section 30 includes an intake port 31 that communicates with the combustion chamber 25, an intake valve 32 for opening and closing the intake port 31, an intake camshaft for driving the intake valve 32, a variable intake timing device 33 for continuously changing the phase angle of the intake camshaft, and an actuator 33*a* of the variable intake timing device 33. The cylinder head section 30 also includes an exhaust port 34 that communicates with the combustion chamber 25, an exhaust valve 35 for opening and closing the exhaust port 34, and an exhaust camshaft 36 for driving the exhaust valve 35. The cylinder head section 30 further includes an ignition plug 37, an ignitor 38 including an ignition coil for generating high voltage to be applied to the ignition plug 37, and an injector (fuel ignition means) 39 for injecting fuel into the intake port 31.

The intake system 40 has an intake pipe 41 that communicates with the intake port 31 and includes an intake manifold, and an air filter 42 provided in an end portion of the intake pipe 41. The intake pipe 41 including the intake manifold cooperates with the intake port 31 to form an intake passage. The intake system 40 further includes a throttle valve 43 disposed in the intake pipe 41 for varying the cross-sectional area of the opening of a common intake passage (as a part of the above-indicated intake passage) that leads to the four cylinders, a throttle valve actuator 43*a* for driving the throttle valve 43, a swirl control valve (which will be called "SCV" when appropriate), and a SCV actuator 44*a*.

When the throttle valve actuator 43*a*, which mainly consists of a DC motor, receives a signal indicative of a target throttle opening TAt determined by an electronic control unit 70 (which will be described) according to an electronically-controlled throttle valve logic, the actuator 43*a* drives the throttle valve 43 so that an actual throttle opening TA becomes equal to the target throttle opening TAt.

The SCV 44 is rotatably supported by the intake pipe 41 at a position downstream of the throttle valve 43 and upstream of the injector 39. When the SCV actuator 44*a*, which mainly consists of a DC motor, receives a drive signal from the electronic control unit 70, the actuator 44*a* drives or rotates the SCV 44 so as to produce the swirling action of the air to be drawn into the combustion chamber 25. In the present specification, the intake pipe 41 including the intake manifold, intake port 31, intake valve 32, SCV 44 and so forth will be called "members that form the intake passage" or "intake-passage forming members".

The exhaust system 50 includes an exhaust manifold 51 that communicates with the exhaust port 34, an exhaust pipe 52 connected to the exhaust manifold 51, and a catalytic converter (three-way catalyst device) 53 mounted in the exhaust pipe 52.

In the meantime, the system of FIG. 1 includes a heat wire air flow meter 61, an intake air temperature sensor 62, an atmospheric pressure sensor (i.e., a sensor for measuring a pressure upstream of the throttle valve) 63, a throttle position sensor 64, and a SCV angle sensor 65. The system further includes a cam position sensor 66, a crank position sensor 67, a water temperature sensor 68, an air/fuel ratio sensor 69, and an accelerator position sensor 81 that provides (a part of) an accelerator operating amount detecting means.

The air flow meter 61 measures the mass flow rate of air that enters the internal combustion engine 10, and outputs a signal indicative of the mass flow rate Ga. The intake air temperature 62, which is provided in the air flow meter 61, measures the temperature of intake air (intake air temperature), and outputs a signal indicative of the intake air temperature THA. The atmospheric pressure sensor 63 measures the pressure upstream of the throttle valve 43 (i.e., the atmospheric pressure), and outputs a signal indicative of the pressure Pa measured upstream of the throttle valve 43. The throttle position sensor 64 measures the opening angle of the throttle valve 43 and outputs a signal indicative of the throttle opening TA. The SCV angle sensor 65 measures the opening angle of the SCV 44 and outputs a signal indicative of the SCV opening angle θiv.

The cam position sensor 66 generates a signal (G2 signal) having one pulse each time the intake camshaft rotates 90° (namely, each time the crankshaft 24 rotates 180°). The crank position sensor 67 outputs a signal having a narrow pulse each time the crankshaft 24 rotates 10° and having a wide pulse each time the crankshaft 24 rotates 360°. This signal represents the engine speed NE. The water temperature sensor 68 measures the temperature of a coolant of the engine 10, and outputs a signal indicative of the coolant temperature THW. The air/fuel ratio sensor 69 is a limiting-current-type air/fuel ratio sensor that senses the oxygen concentration in exhaust gas that flows into the catalytic converter 53, and is adapted to output a voltage signal vabyfs indicative of the air/fuel ratio abyfs. The accelerator position sensor 81 measures the amount of operation (or depression) of an accelerator pedal 82 operated by the driver, and outputs a signal indicative of the operating amount Accp of the accelerator pedal 82.

The electronic control unit 70 is a microcomputer mainly consisting of a CPU 71, ROM 72, RAM 73, backup RAM 74, interface 75 and other components, which are connected to each other by a bus. The ROM 72 stores in advance programs to be executed by the CPU 71, tables (e.g., lookup tables and maps), constants, and the like, and the RAM 73 allows the CPU 71 to temporarily store data as needed. The backup RAM 74 stores data while the power supply is in the ON state, and holds the stored data even while the power supply is in the OFF state. The interface 75, which includes AD converters, are connected to the sensors 61 through 69 and 81. In operation, the interface 75 supplies signals from the sensors 61–69, 81 to the CPU 71, and sends drive signals to the actuator 33*a* of the variable intake timing device 33, ignitor 38, injector 39, throttle valve actuator 43*a* and the SCV actuator 44*a*, according to commands received from the CPU 71.

Figure 2:
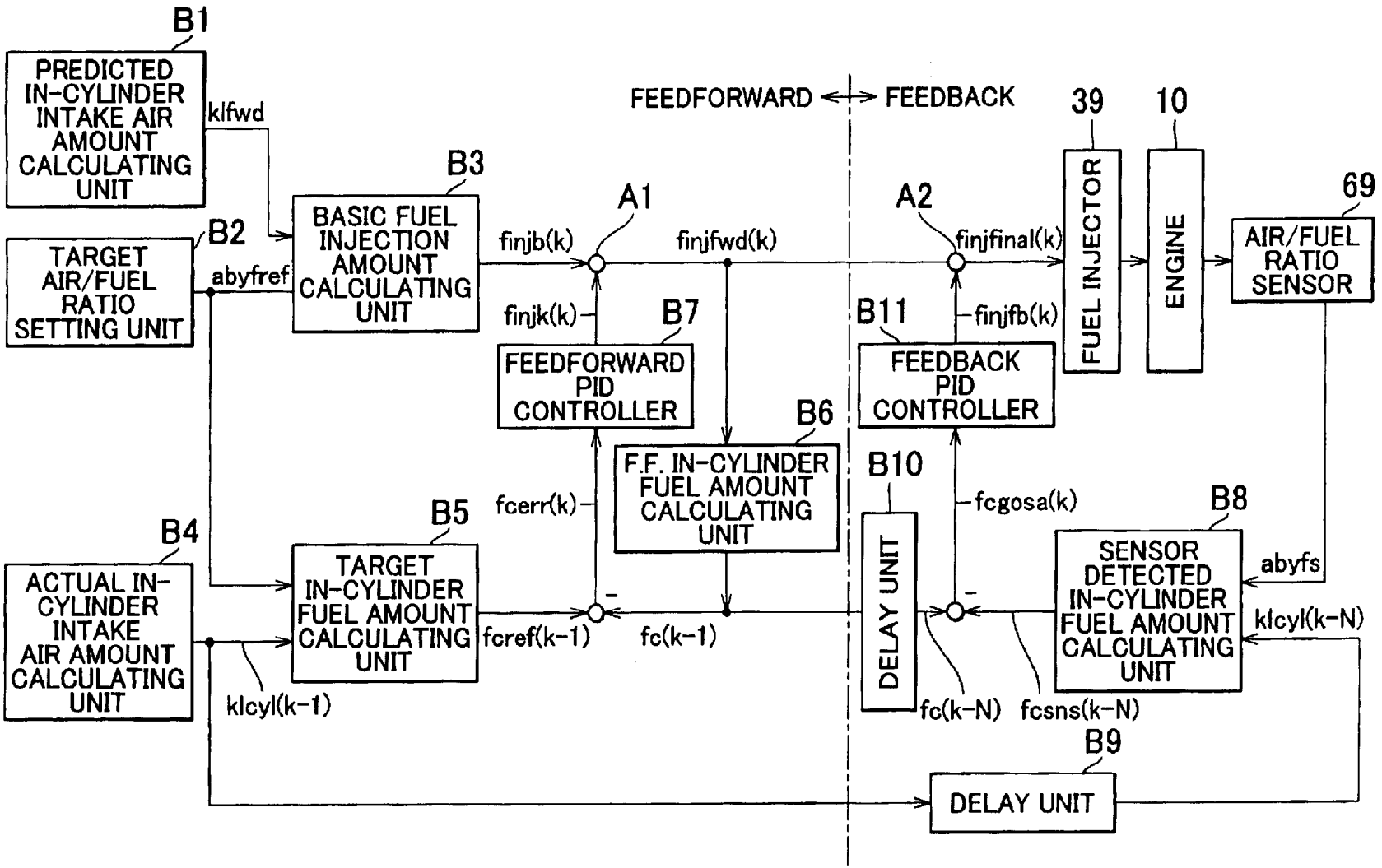
FIG. 2 is a block diagram showing respective functions performed by an electronic control unit shown in FIG. 1 for determining a fuel injection amount.

Referring next to FIG. 2, a method in which the fuel injection amount control apparatus constructed as described above determines the amount (final fuel injection amount) of fuel to be injected into a fuel injection cylinder (i.e., a cylinder into which fuel is to be injected in the next engine cycle). As described later, the function of each block B1, B2, . . . , A1 and A2 is accomplished by the CPU 71 when it executes a certain program (control routine). In the following description, variables accompanied by (k) mean that the variables are associated with the coming intake stroke (i.e., the intake stroke that comes next, following the current exhaust stroke) of the fuel injection cylinder (which will also be called "particular cylinder"). Similarly, variables accompanied by (k−1) mean that the variables are associated with the last intake stroke, i.e., the intake stroke one cycle before the coming intake stroke of the fuel injection cylinder, and variables accompanied by (k−N) mean that the variables are associated with the intake stroke N cycles before the coming intake stroke of the fuel injection cylinder.

Method of Determining Final Fuel Injection Amount finifinal(k)

The final fuel injection amount finjfinal(k) is obtained by correcting a basic fuel injection amount finjb(k) by using a feedforward correction amount finjk(k) to provide a feedforward fuel injection amount finjfwd(k), and further correcting the feedforward fuel injection amount finjfwd(k) by using a feedback correction amount finjfb(k), as indicated in expression (1) below. In the following description, methods of calculating the basic fuel injection amount finjb(k), feedforward correction amount finjk(k) and the feedback correction amount finjfb(k) will be explained in this order.

$$finj\text{final}(k)=finjb(k)+finjk(k)+finjfb(k)=finjfwd(k)+finjfb(k) \quad (1)$$

(1) Calculation of Basic Fuel Injection Amount finjb(k)

The fuel injection amount control apparatus needs to inject an appropriate amount of fuel to a cylinder that is currently in an intake stroke or in an exhaust stroke immediately before an intake stroke (which cylinder is called "fuel injection cylinder" or "particular cylinder") at a certain point of time before a point of time when the intake valve 32 of the cylinder in question shifts from an open state in the intake stroke to a closed state. This point of time may be called "intake valve closing time" or "the time of completion of the intake stroke".

To this end, the fuel injection amount control apparatus shown in FIG. 2 causes a predicted in-cylinder intake air amount calculating unit B1 to predict or estimate an amount of intake air that would exist in the fuel injection cylinder at the time of completion of the intake stroke, as a predicted in-cylinder intake air amount klfwd (=klfwd(k)), at a point of time prior to the time of completion of the intake stroke of the fuel injection cylinder, and injects fuel whose amount is determined based on the predicted in-cylinder intake air amount into the same cylinder at a point of time prior to the closing time of the intake valve 32 of the cylinder.

More specifically, the fuel injection amount control apparatus of the present embodiment sets the time of completion of fuel injection as 75° crank angle before the intake top dead center (which is denoted by "BTDC 75° CA" and similar denotation applies to other crank angles) of the fuel injection cylinder. Therefore, the predicted in-cylinder intake air amount calculation unit B1 starts calculation of the predicted in-cylinder intake air amount klfwd of the fuel injection cylinder at BTDC 90° CA, a time point before BTDC 75° CA, in view of the time required for injection (opening duration of the injector 39), the calculation time of the CPU, and so forth.

Namely, the predicted in-cylinder intake air amount calculating unit B1 predicts or estimates a future value (a value to be obtained ahead of the current point of time) of the throttle opening as an operating state quantity of the engine used for predicting at least the in-cylinder intake air amount. The predicted/estimated throttle opening will be hereinafter called "predicted (or estimated) throttle opening TAest". The predicted in-cylinder intake air amount calculation unit B1 then calculates the predicted in-cylinder intake air amount klfwd, based on an intake air amount map (lookup table), the predicted throttle opening TAest, the engine speed NE measured at the time of calculation, and the valve timing VT measured at the time of calculation. The intake air amount map defines the relationship among the throttle opening, the engine speed, the valve timing (intake valve timing) that specifies the crank angle at the time of closing of the intake valve 32, and the in-cylinder intake air amount.

On the other hand, the control apparatus of the embodiment causes a target air/fuel ratio setting unit B2 to set a target air/fuel ratio abyfref according to engine operating state quantities, such as the accelerator operating amount Accp and the coolant temperature THW. The target air/fuel ratio is set to the stoichiometric air/fuel ratio abyfstoich in a normal operating state. In the following description, therefore, it is assumed that the target air/fuel ratio is always equal to the stoichiometric air/fuel ratio abyfstoich.

Subsequently, the control apparatus causes a basic fuel injection amount calculating unit B3 to calculate the basic fuel injection amount finjb(k), based on a tentative target in-cylinder fuel amount tfcref (=klfwd/abyfref) that is obtained by dividing the predicted in-cylinder intake air amount klfwd by the target air/fuel ratio abyfref. The value tfcref is an amount of fuel that is expected to be needed for achieving the target air/fuel ratio abyfref in the coming intake stroke of the fuel injection cylinder (particular cylinder). This value tfcref is called "tentative" target in-cylinder fuel amount because the predicted in-cylinder intake air amount klfwd involves a prediction or estimation error. An excess or shortage of the basic fuel injection amount finjb(k) due to the prediction/estimation error is compensated for by a feedforward correction amount finjk(k) as described later.

Here, the function of the basic fuel injection amount calculating unit B3 will be described in detail. The basic fuel injection amount calculating unit B3 calculates the basic fuel injection amount finjb(k), taking account of influences due to fuel deposition on the intake-passage forming members (namely, using an inverse model of a fuel behavior model that represents the behavior of fuel deposited on the intake-passage forming members). The inverse model of the fuel behavior model will be described below.

<Inverse Model of Fuel Behavior Model>

Assuming that fuel is injected in an injection amount fib(k) to the fuel injection cylinder for the coming intake stroke, the amount fin of fuel actually drawn into the same cylinder during the coming intake stroke is calculated according to expression (2) below. In the expression (2), fwp(k) represents a port fuel deposition amount that is an amount of fuel deposited on the intake port (or a member defining the intake port) of the cylinder, fwv(k) is a valve fuel deposition amount that is an amount of fuel deposited on the intake valve of the cylinder, Rp is a fuel deposition rate at which the fuel is deposited on the intake port, Rv is a fuel deposition rate at which the fuel is deposited on the intake valve, Pp is a fuel left-over rate at which the fuel remains on the intake port, and Pv is fuel left-over rate at which the fuel remains on the intake valve. It is to be noted that the fuel deposition rates Rp, Rv and the fuel left-over rates Pp Pv are functions of the in-cylinder intake air amount, the engine speed NE and the valve timing VT.

$$fin=(1-Rp-Rv)\cdot fib(k)+(1-Pp)\cdot fwp(k)+(1-Pv)\cdot fwv(k) \quad (2)$$

In order to introduce such an amount of fuel that is equal to the tentative target in-cylinder fuel amount tfcref into the fuel injection cylinder by injecting fuel in the basic fuel injection amount finjb(k), therefore, the basic fuel injection amount finjb(k) is calculated according to expression (3) indicated below, which derives from the above expression (2) in which the fuel amount fin is made equal to the tentative target in-cylinder fuel amount tfcref, and the injection amount fib(k) is made equal to the basic fuel injection amount finjb(k). Namely, the above-indicated expression (2) in which the fuel amount fin is substituted by the tentative target in-cylinder fuel amount tfcref and the injection amount fib(k) is substituted by the basic fuel injection amount finjb(k) is solved in terms of the basic fuel injection amount finjb(k), to provide the expression (3) below. Thus, the expression (3) mathematically represents an inverse model of the fuel behavior, and the basic fuel injection amount calculating unit B3 calculates the basic fuel injection amount finjb(k) according to the expression (3).

The basic fuel injection amount calculating unit B3 employs the predicted in-cylinder intake air amount klfwd as an in-cylinder intake air amount for obtaining the fuel deposition rates Rp, Rv and fuel left-over rates Pp, Pv in the expression (3) below, and employs the engine speed NE and the valve timing VT at the current time (i.e., at the time of calculation) as the engine speed and the valve timing. Also, the port fuel deposition amount fwp(k) and the valve fuel deposition amount fwv(k) used in the expression (3) below are updated according to expression (5) and expression (6) as described later. In this manner, the basic fuel injection amount finjb(k) is calculated.

$$finjb(k)=\{tfcref-(1-Pp)\cdot fwp(k)-(1-Pv)\cdot fwv(k)\}/(1-Rp-Rv) \quad (3)$$

(2) Calculation of Feedforward Correction Amount finjk(k) and Feedforward Fuel Injection Amount finjfwd(k)

As described above, the predicted in-cylinder intake air amount klfwd involves a prediction/estimation error, and therefore the basic fuel injection amount finjb(k) also involves an error since the amount finjb(k) is calculated according to the inverse model of fuel behavior that uses the fuel deposition rates Rp, Rv and the fuel left-over rates Pp, Pv obtained based on the tentative target in-cylinder fuel amount tfcref (=klfwd/abyfref) and the predicted in-cylinder intake air amount klfwd.

In view of the above, the fuel injection amount control apparatus of the embodiment compensates for the error in the basic fuel injection amount finjb(k) by using a feedforward correction amount finjk(k). More specifically, assuming that the feedforward fuel injection amount finjfwd(k−1) (=finjb(k−1)+finjk(k−1)) obtained by correcting the last basic fuel injection amount finjb(k−1) by using the last feedforward correction amount finjk(k−1) is injected for the last intake stroke of the fuel injection cylinder, the control apparatus calculates an amount of fuel that is supposed on calculation to be introduced into the cylinder for the last intake stroke, as a calculated in-cylinder fuel amount fc(k−1), based on the last feedforward fuel injection amount finjfwd(k−1) and the forward model of the fuel behavior model.

The control apparatus of the embodiment also obtains an actual in-cylinder intake air amount klcyl (=klcyl(k−1)) in the last intake stroke, at a point of time when the last intake stroke is finished (i.e., at a point of time when the predicted in-cylinder intake air amount klfwd(k−1) is confirmed). The control apparatus then divides the actual in-cylinder intake air amount klcyl by the target air/fuel ratio so as to obtain an amount of fuel (which will be called "feedforward target in-cylinder fuel amount fcref(k−1)(=klcyl/abyfref)) that should have been actually introduced into the cylinder so as to make the air/fuel ratio in the last intake stroke equal to the target air/fuel ratio abyfef.

The control apparatus then calculates a difference between the feedforward target in-cylinder fuel amount fcref(k−1) and the calculated in-cylinder fuel amount as an amount of fuel that is supposed on calculation to be supplied to the cylinder for the last intake stroke. The control apparatus then calculates a feedforward correction amount finjk(k) for reducing this difference, and calculates the feedforward fuel injection amount finjfwd(k) for the coming intake stroke by correcting the basic fuel injection amount finjb(k) by using the feedforward correction amount finjk(k).

As described above, at the point of time when the predicted in-cylinder intake air amount klfwd(k−1) is confirmed, namely, at a point of time when the engine operating state quantity (at least the predicted throttle opening TAest) used for calculating the predicted in-cylinder intake air amount klfwd(k−1) is confirmed, the control apparatus calculates the actual in-cylinder intake air amount klcyl(=klcyl(k−1)) of the last intake stroke, based on the confirmed engine operating state quantity. The control apparatus then determines the feedforward fuel injection amount finjfwd(k) so as to reduce a difference between "the amount (feedforward target in-cylinder fuel amount) of fuel that should have been actually introduced into the cylinder so that the air/fuel ratio in the last intake stroke coincides with the target air/fuel ratio abyfref" which is calculated based on the actual in-cylinder intake air amount klcyl, and the calculated in-cylinder fuel amount fc(k−1). Accordingly, an excess or shortage of the fuel injection amount due to an estimation error in the predicted in-cylinder intake air amount klfwd with respect to a certain intake stroke is immediately compensated for in the next and subsequent intake strokes.

Here, the function of each of the units for calculating the feedforward fuel injection amount finjfwd(k) will be described. An actual in-cylinder intake air amount calculating unit B4 of the fuel injection amount control apparatus calculates the actual in-cylinder intake air amount klcyl of the last intake stroke, at a point of time after completion of the last intake stroke, based on the actual throttle opening TAact(k−1) measured at the time of completion of the last intake stroke, the current engine speed NE, the current valve timing VT, and the above-described intake air amount map.

On one hand, a target in-cylinder fuel amount calculating unit B5 calculates the feedforward target in-cylinder fuel amount fcref(k−i)(=klcyl/abyfref) for the last intake stroke, by dividing the actual in-cylinder intake air amount klcyl of the last intake stroke by the target air/fuel ratio abyfref obtained by the target air/fuel ratio setting unit B2.

On the other hand, a feedforward in-cylinder fuel amount calculating unit B6 calculates the calculated in-cylinder fuel amount fc(k−1) for the last intake stroke, based on the last feedforward fuel injection amount finjfwd(k−1) and the forward model of the fuel behavior as represented by expressions (4)–(6) below. In the expression (4), the port fuel deposition amount fwp(k−1) is an amount of fuel deposited on the intake port of the fuel injection cylinder after the second last intake stroke of the cylinder and immediately before the last intake stroke, and the valve fuel deposition amount fwv(k−1) is an amount of fuel deposited on the intake valve of the fuel injection cylinder after the second last intake stroke of the cylinder and immediately before the last intake stroke. The fuel deposition rates Rp, Rv and the fuel left-over rates Pp, Pv used in the expressions (4)–(6) below are determined based on the actual in-cylinder intake air amount klcyl of the last intake stroke, the current engine speed NE and the current valve timing VT.

$$fc(k-1)=(1-Pp)\cdot fwp(k-1)+(1-Pv)\cdot fwv(k-1)+(1-Rp-Rv)\cdot finjfwd(k-1) \quad (4)$$

$$fwp(k)=Pp\cdot fwp(k-1)+Rp\cdot finjfwd(k-1) \quad (5)$$

$$fwv(k)=Pv\cdot fwv(k-1)+Rv\cdot finjfwd(k-1) \quad (6)$$

Subsequently, the fuel injection amount control apparatus calculates a difference between the feedforward target in-cylinder fuel amount fcref(k−1) and the calculated in-cylinder fuel amount fc(k−1) for the last intake stroke, as a feedforward fuel error amount (deviation) fcerr(k), as indicated in expression (7) below. The control apparatus then causes a feedforward PID controller (feedforward correction amount calculating unit) B7 to subject the feedforward fuel error amount fcerr(k) to a PID control process so as to provide a feedforward correction amount finjk(k). The PID control process of the PID controller B7 is performed according to the following expressions (8) through (10). In these expressions, Kp, Kd and Ki are proportional gain, derivative gain and integral gain, respectively. Also, fcerrdiff(k) is a differentiated error amount, and fcerrin(k) is an integrated error amount.

$$fcerr(k)=fcref(k-1)-fc(k-1) \quad (7)$$

$$finjk(k)=Kp\cdot fcerr(k)+Kd\cdot fcerrdiff(k)+Ki\cdot fcerrin(k) \quad (8)$$

$$fcerrdiff(k)=fcerr(k)-fcerr(k-1) \quad (9)$$

$$fcerrin(k)=fcerrin(k-1)+fcerr(k) \quad (10)$$

With the basic fuel injection amount finjb(k) and the feedforward correction amount finjk(k) calculated as described above, a feedforward fuel injection amount calculating unit A1 of the fuel injection amount control apparatus then calculates a feedforward fuel injection amount finjfwd(k) for the coming intake stroke, by adding the basic fuel injection amount finjb(k) and the feedforward correction amount finjk(k) (refer to the above-indicated expression (1)).

Thus, block B1 through block B7 and block A1 cooperate to form a feedforward system, in which an excess or shortage of the fuel injection amount due to a prediction/estimation error in the predicted in-cylinder intake air amount klfwd is compensated for or eliminated. This arrangement makes it possible to compensate for an excess or shortage of the fuel injection amount without using a sensor, such as the air/fuel ratio sensor 69, provided in the exhaust system. Furthermore, an excess or shortage of fuel that appeared in the last intake stroke is immediately compensated for by the fuel injection amount for the coming and subsequent intake strokes. Thus, even where the engine is in a transient operating state, such as a sudden acceleration or deceleration, and the predicted in-cylinder intake air amount klfwd is likely to involve a prediction/estimation error, resultant fluctuations in the air/fuel ratio of an air-fuel mixture drawn into the engine relative to the target air/fuel ratio can be promptly suppressed, thus assuring improved emission control performance and improved driveability.

(3) Calculation of Feedback Correction Amount finjfb(k)

Next, a method of calculating the feedback correction amount finjfb(k) will be explained. The fuel injection amount control apparatus causes a sensor detected in-cylinder fuel amount calculating unit B8 to calculate a sensor detected in-cylinder fuel amount fcsns(k−N) (=klcyl (k−N)/abyfs) by dividing an actual in-cylinder intake air amount klcyl(k−N) by a detected air/fuel ratio abyfs obtained based on an output vabyfs of the air/fuel ratio sensor 69. The actual in-cylinder intake air amount klcyl(k−N), which was obtained in the intake stroke that occurred N cycles before the coming intake stroke, is transmitted to the calculating unit B8 via a delay unit B9. The value "N" is determined depending upon the time required from induction of an air-fuel mixture into the cylinder to a point at which the air/fuel ratio sensor 69 detects the air/fuel ratio of exhaust gas produced after combustion of the air-fuel mixture. Thus, the sensor detected in-cylinder fuel amount fcsns(k−N) represents an amount of fuel actually supplied to the fuel injection cylinder for the intake stroke N cycles (a predetermined number of cycles) before the coming intake stroke.

Then, the fuel injection amount control apparatus acquires the calculated in-cylinder fuel amount fc(k−N) calculated by the feedforward in-cylinder fuel amount calculating unit B6 with respect to the intake stroke N cycles before the coming intake stroke, via a delay unit B10, and calculates a feedback fuel error amount (deviation) fcgosa(k) by subtracting the sensor detected in-cylinder fuel amount fesns(k−N) from the calculated in-cylinder fuel amount fc(k−N), as indicated in expression (11) below. The control apparatus then causes a feedback PID controller (feedback correction amount calculating unit) B11 to subject the feedback fuel error amount fcgosa(k) to a PID control process, to provide a feedback correction amount finjfb(k) for reducing the feedback fuel error amount fcgosa(k). The PID control process is performed according to the following expressions (12) through (14). In these expressions, Gp, Gd and Gi are proportional gain, derivative gain and integral gain, respectively. Also, fcgosadiff(k) is a differentiated error amount, and fcgosain (k) is an integrated error amount.

$$fcgosa(k)=fc(k-N)-fcsns(k-N) \tag{11}$$

$$finjfb(k)=Gp\cdot fcgosa(k)+Gd\cdot fcgosadiff(k)+Gi\cdot fcgosain(k) \tag{12}$$

$$fcgosadiff(k)=fcgosa(k)-fcgosa(k-1) \tag{13}$$

$$fcgosain(k)=fcgosain(k-1)+fcgosa(k) \tag{14}$$

Subsequently, the fuel injection amount control apparatus causes a final fuel injection amount calculating unit A2 to correct the feedforward fuel injection amount finjfwd(k) for the coming intake stroke with the feedback correction amount finjfb(k) by adding the feedback correction amount finjfb(k) to the feedforward fuel injection amount finjfwd(k), thereby to provide a final fuel injection amount finjfinal(k). Then, fuel is injected in the final fuel injection amount finfinal(k) from the injector 39 into the fuel injection cylinder of the engine 10.

Thus, block B8 through block B10, block A1 and the air/fuel ratio sensor 69 cooperate to form a feedback system, which functions to reduce a steady-state deviation of the air/fuel ratio of the air-fuel mixture from the target air/fuel ratio due to changes in the properties of the fuel, variations in the performance of the injectors 39 resulting from manufacturing errors, and the like. The method of calculating the final fuel injection amount finjfinal(k) has been summarized above.

Next, the actual operations of the fuel injection amount control apparatus of the embodiment will be described.

Calculation of Predicted Throttle Opening TAest

Figure 3:
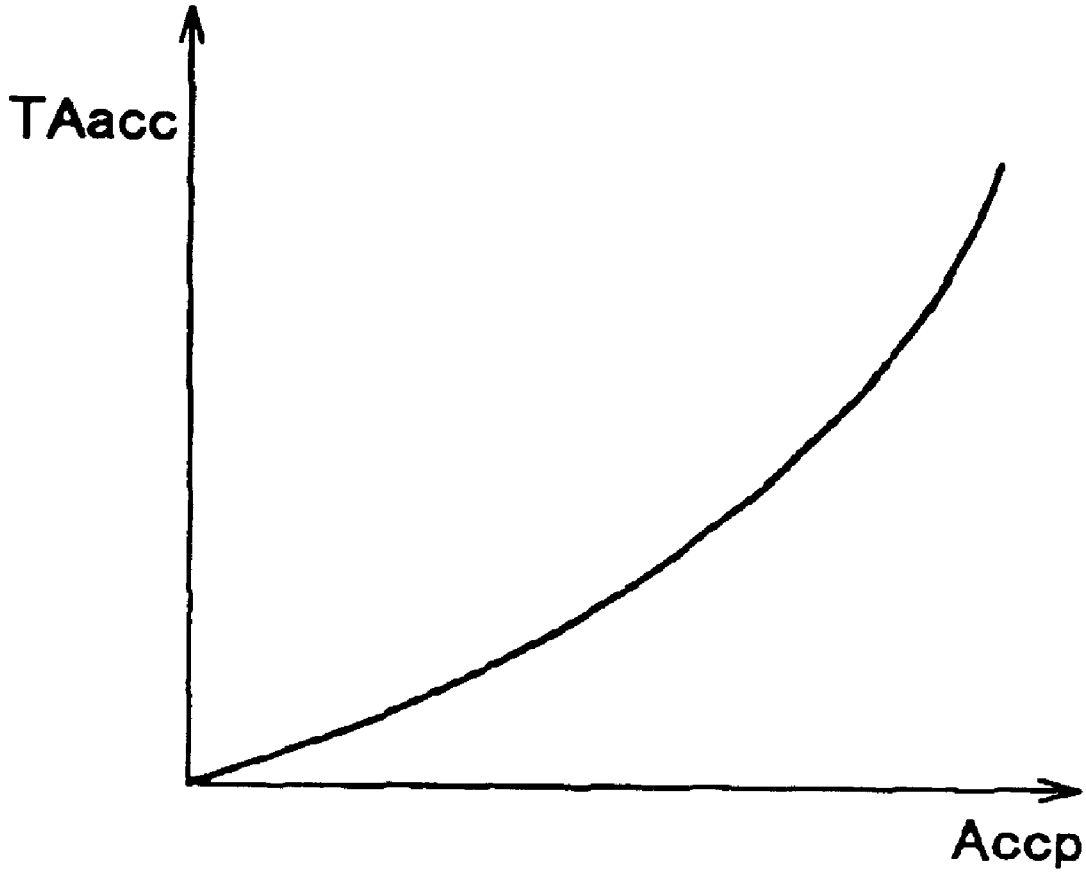
FIG. 3 is a view showing a table that defines the relationship between an amount of operation of an accelerator pedal and a provisional target throttle opening, which table is referred to by a CPU shown in FIG. 1.
Figure 4:
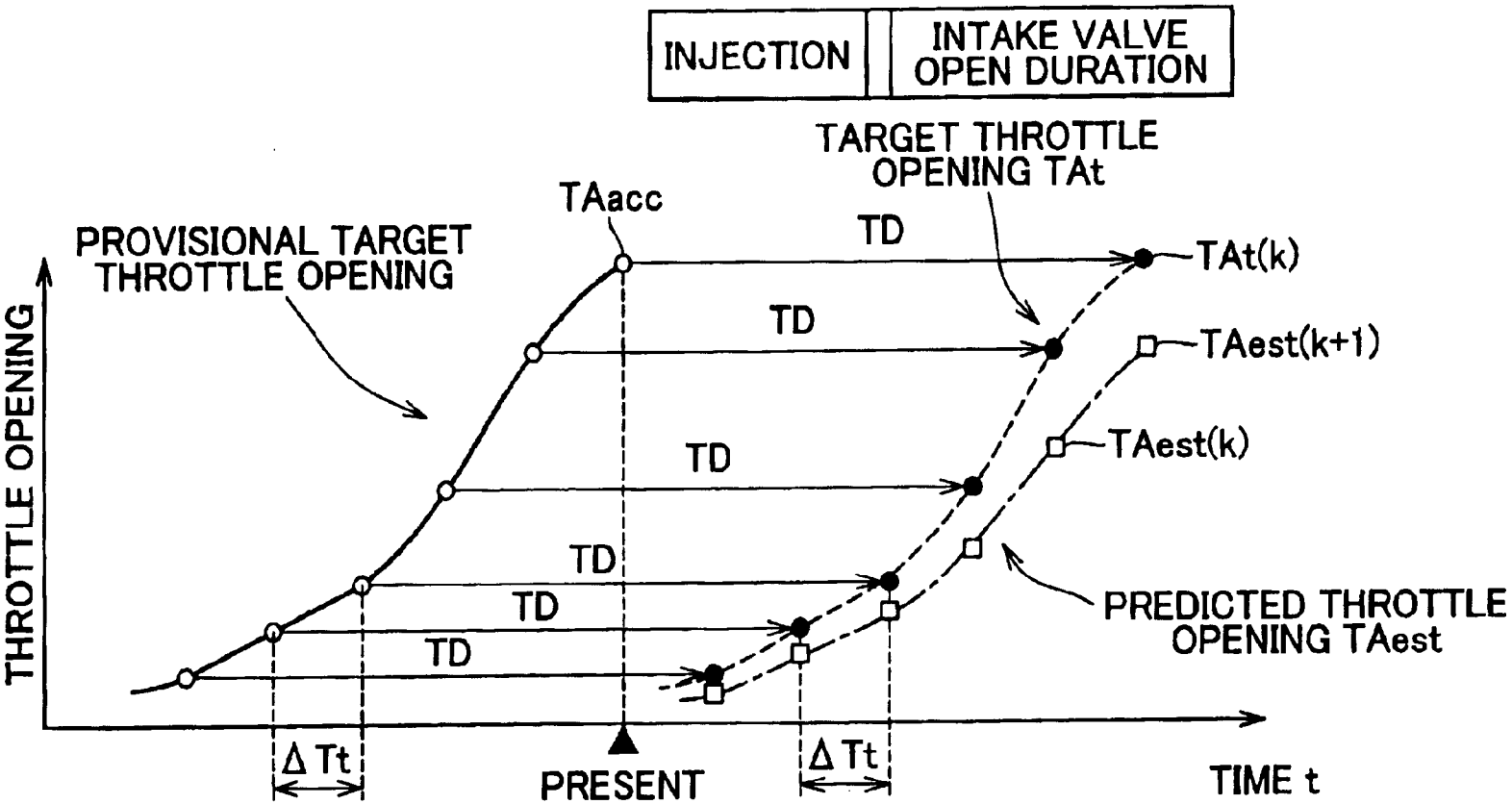
FIG. 4 is a time chart showing changes in the provisional target throttle opening, target throttle opening and the predicted throttle opening.

The CPU 71 reads an accelerator operating amount Accp based on an output value of the accelerator position sensor 81 each time a calculation period ΔTt (for example, 8 msec) elapses, and obtains a provisional target throttle opening TAacc of the current control cycle based on the read accelerator operating amount Accp and the table of FIG. 3 that defines the relationship between the accelerator operating amount Accp and the target throttle opening TAacc. The CPU 71 then delays the provisional target throttle opening TAacc by a predetermined delay time TD, as shown in the time chart of FIG. 4, and sets the delayed provisional target throttle opening TAacc as a target throttle opening TAt, which is then output to the throttle valve actuator 43*a*. While the delay time TD is a fixed time in the present embodiment, the delay time TD may be a variable time that varies depending upon the engine speed NE. For example, the delay time TD may be set to time T270 required for the engine to revolve by a predetermined crank angle (e.g., crank angle 270° CA).

Even in the case where the target throttle opening TAt is generated from the CPU 71 to the throttle valve actuator 43*a*, the actual throttle opening TA follows the target throttle opening TAt with a certain delay due to, for example, a delay in the throttle valve actuator 43*a* and the inertia of the throttle valve 43. In view of this fact, the CPU 71 predicts or estimates a throttle opening TAest(k+1) to be established upon a lapse of the delay time TD, according to the following expression (15).

$$TAest(k+1)=TAest(k)+\Delta Tt\cdot f(TA(k),\ TAest(k)) \tag{15}$$

Figure 5:
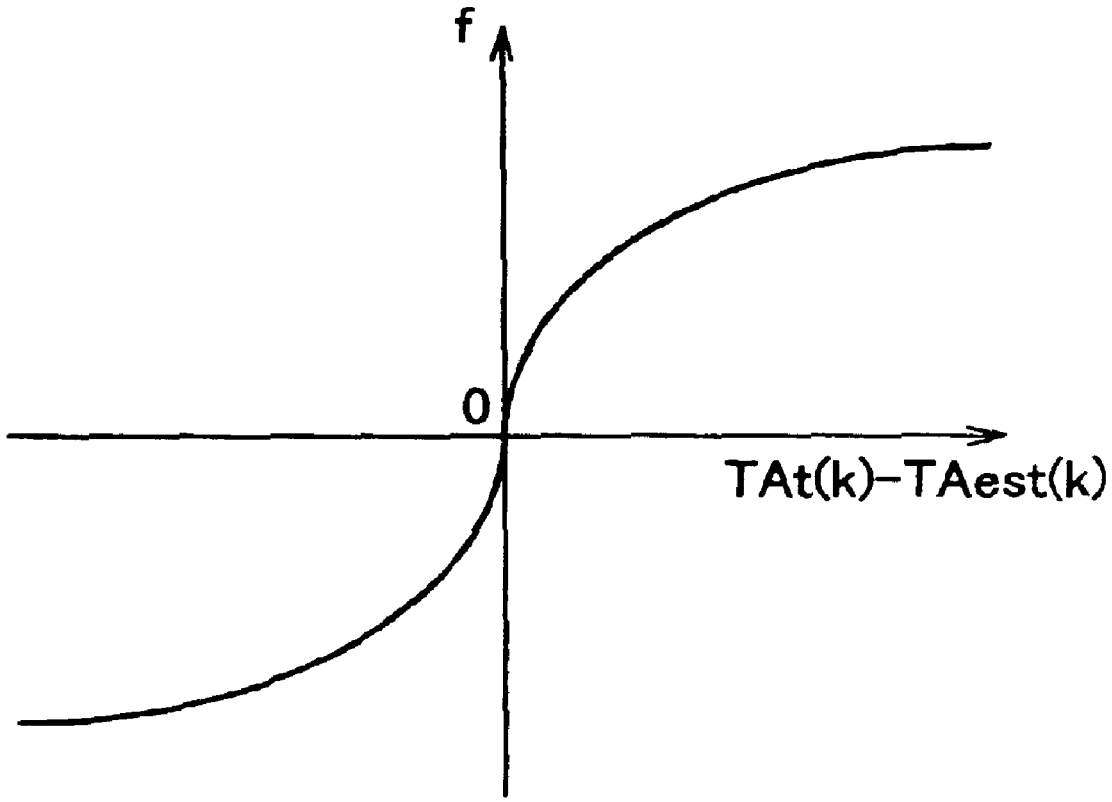
FIG. 5 is a graph indicating a function used for calculation of the predicted throttle opening.

In the above expression (15), TAest(k+1) represents predicted throttle opening TAest that is newly predicted or estimated at the current calculation timing, and TAt(k) represents target throttle opening TAt that is newly obtained at the current calculation timing, while TAest(k) represents the latest predicted throttle opening TAest that has been already predicted or estimated and is available at the current calculation timing (namely, throttle opening TAest that was predicted or estimated at the last calculation timing). In the above expression (15), f (TAt(k), TAest(k)) is a function that takes the larger value as a difference ΔTA (=TAt(k)−TAest (k)) between TAt(k) and TAest(k) becomes larger, namely, a function f whose output monotonously increases with ΔTA, as shown in FIG. 5.

Thus, the CPU 71 newly determines the target throttle opening TAt to be established upon a lapse of the delay time TD and newly predicts or estimate the throttle opening TAest that is supposed to be established upon a lapse of the delay time TD, at the current calculation timing. In this manner, the CPU 71 stores the target throttle opening TAt and the predicted throttle opening TAest from the current point of time to the lapse of the delay time TD in the RAM 73, such that these values TAt, TAest vary with time from the current point of time.

Figure 6:
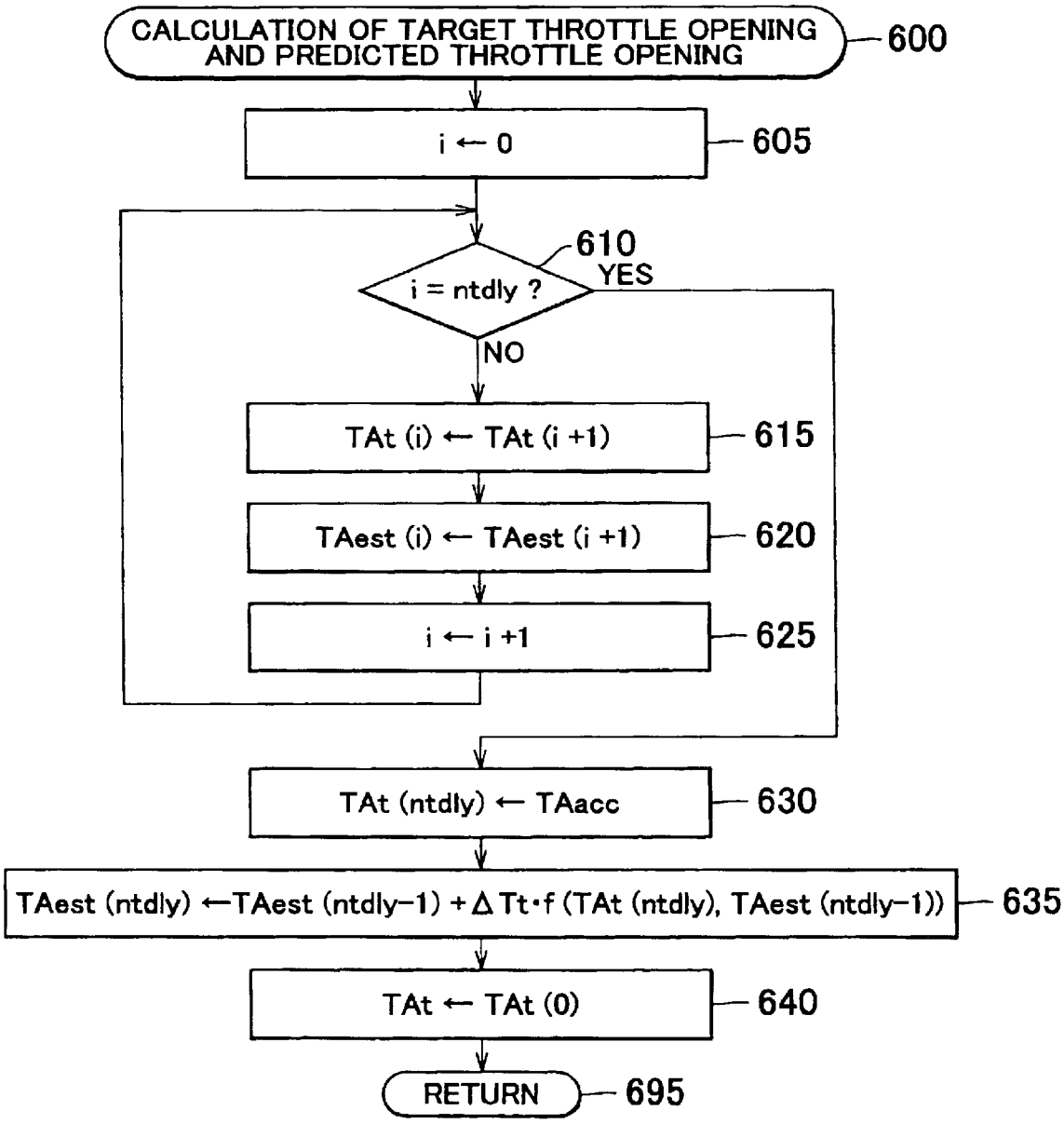
FIG. 6 is a flowchart showing a program executed by the CPU shown in FIG. 1 for calculating the target throttle opening and the predicted throttle opening.

FIG. 6 is a flowchart illustrating a control routine executed by the CPU 71 each time the predetermined time ATt elapses, for calculating the predicted throttle opening TAest as described above. The CPU 71 starts the process in step 600 in certain timing, and proceeds to step 605 to set variable "i" to 0. The CPU 71 then proceeds to step 610 to determine whether the variable "i" is equal to a number of times ntdly for delay. The number of times ntdly for delay is obtained by dividing the delay time TD by the calculation period ΔTt.

Since the variable "i" is 0 at this point of time, the CPU 71 makes a negative determination (NO) in step 610, and proceeds to step 615 to store the value of the provisional target throttle opening TAt(i+1) in the provisional target throttle opening TAt(i). The CPU 71 then proceeds to step 620 to store the value of the predicted throttle opening TAest(i+1) in the predicted throttle opening TAest(i). With this process, the value of the provisional target throttle opening TAt(1) is stored in the provisional target throttle opening TAt(0), and the value of the predicted throttle opening TAest(1) is stored in the predicted throttle opening TAest(0).

Subsequently, the CPU 71 increases the value of the variable "i" by 1 in step 625, and returns to step 610. If the value of the variable "i" is smaller than the number of times ntdly for delay, step 615 through step 625 are executed again. Namely, step 615 through step 625 are repeatedly executed until the value of the variable "i" becomes equal to the number of times ntdly for delay. In this manner, the value of the provisional target throttle opening TAt(i+1) is successively shifted to the provisional target throttle opening TA(i), and the predicted throttle opening TAest(i+1) is successively shifted to the predicted throttle opening TAest (i).

If the value of the variable "i" becomes equal to the number of times ntdly for delay after repeated execution of step 625, the CPU 71 makes an affirmative determination (YES) in step 610, and proceeds to step 630. In step 630, the provisional target throttle opening TAacc of the current cycle is obtained based on the actual accelerator operating amount Accp measured at the current point of time and the table shown in FIG. 3, and the thus obtained provisional target throttle opening TAacc is stored in the provisional target throttle opening TAt(ntdly).

Subsequently, the CPU 71 proceeds to step 635 in which the predicted throttle opening TAest(ntdly) of the current cycle is calculated according to the predicted throttle opening TAest(ntdly−1) obtained in the last control cycle, the provisional target throttle opening TAt(ntdly) of the current cycle, and an expression specified in the block of step 635 in FIG. 6, which is based on the above-indicated expression (15). The CPU 71 then proceeds to step 640 to set the value of the provisional target throttle opening TAt(0) as the target throttle opening TAt, and proceeds to step 695 to finish the present control routine.

As described above, the content of the memory associated with the target throttle opening TAt is shifted one by one each time the routine of FIG. 6 is executed, and the value stored in the provisional target throttle opening TAt(0) is set as the target throttle opening TAt to be generated to the throttle valve actuator 43*a*. Namely, the value stored in the provisional target throttle opening TAt(ntdly) through execution of the current cycle of the routine of FIG. 6 will be stored in TAt(0) and will provide the target throttle opening TAt when this routine is repeated the number of times ntdly for delay. With regard to the memory associated with the predicted throttle opening TAest, the predicted throttle opening TAest for use upon a lapse of a predetermined time (m·ΔTt; m is integer) is stored in TAest(m) in the memory.

Calculation of Actual In-Cylinder Intake Air Amount klcyl

Figure 7:
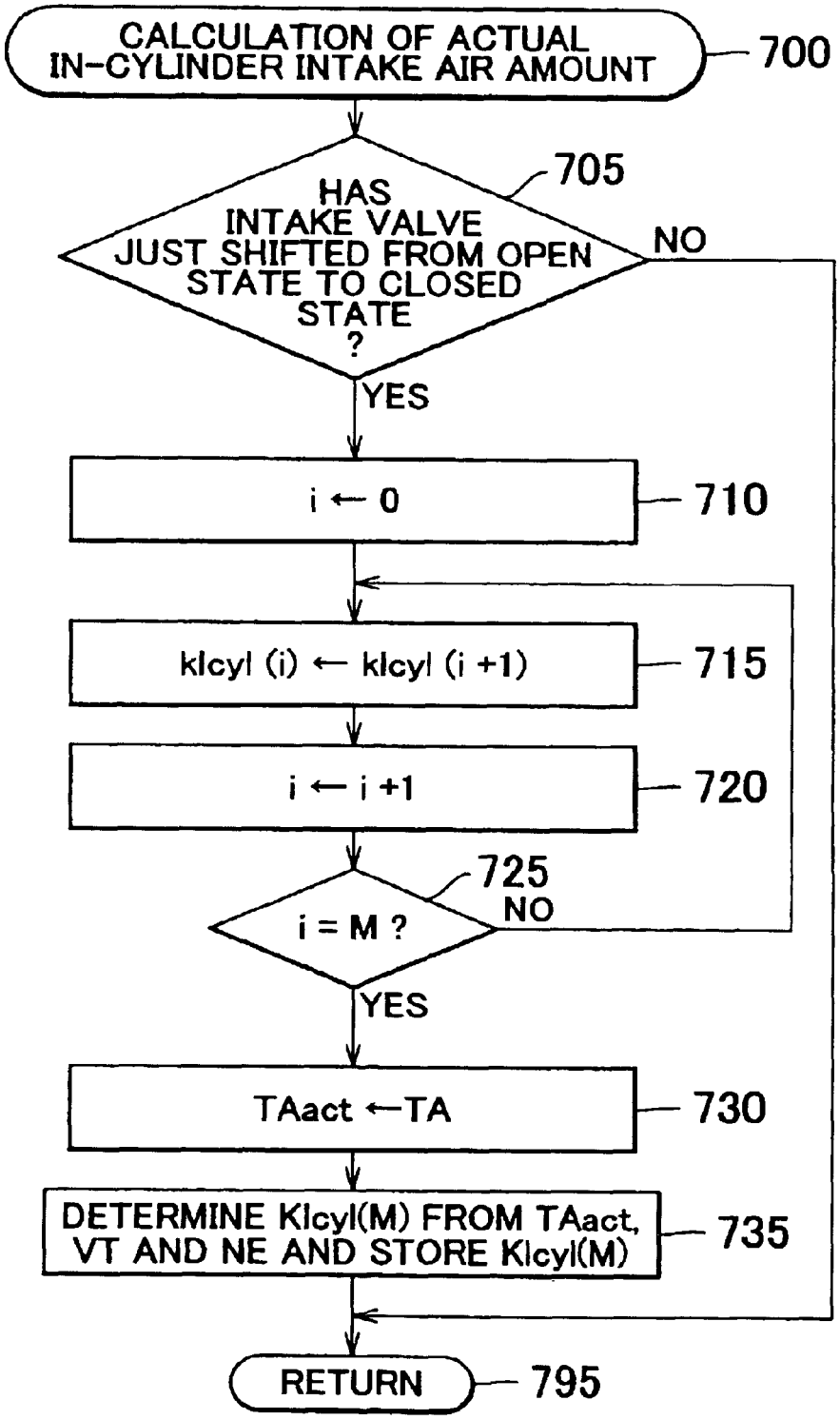
FIG. 7 is a flowchart showing a program executed by the CPU shown in FIG. 1 for calculating an actual in-cylinder intake air amount.

Next, the operation of the CPU 71 to calculate the actual in-cylinder intake air amount klcyl(k) of the intake stroke will be described with reference to FIG. 7. FIG. 7 is a flowchart illustrating a control routine executed by the CPU 71 at predetermined time intervals. While the CPU 71 executes the routine of FIG. 7 with respect to a particular cylinder, the same routine as that of FIG. 7 is to be executed independently with respect to the other cylinders.

The CPU 71 starts the process in step 700 in certain timing, and proceeds to step 705 to determine whether the intake valve 32 of the particular cylinder has just changed from the open state to the closed state (i.e., whether the intake valve 32 was closed immediately before the current point of time). If the intake valve 32 was not closed immediately before the current time, the CPU 71 makes a negative determination (NO) in step 705, and proceeds to step 795 to finish the current cycle of the routine.

If the intake valve 32 of the particular cylinder was closed immediately before the time when the CPU 71 executes step 705, the CPU 71 makes an affirmative determination (YES) in step 705, and proceeds to step 710 to set the value of variable "i" to 0. In the following step 715, the actual in-cylinder intake air amount klcyl(i+1) that was already obtained during or before execution of the last cycle of this routine and is stored in the RAM 73 is stored in klcy(i). The CPU 71 then proceeds to step 720 to increase the value of the variable "i" by 1, and then proceeds to step 725 to determine whether the value of the variable "i" becomes equal to a predetermined value M. The value "M" is equal to or larger than the above-indicated value N (>1).

Since the variable "i" is equal to 1 at this point of time, the CPU 71 makes a negative determination (NO) in step 725, and returns to step 715. Through the above process, the value of the actual in-cylinder intake air amount klcy(1) is stored in klcyl(0). The CPU 71 then repeatedly executes step 715 through step 725. As a result, the actual in-cylinder intake air amount klcyl(i+1) is successively shifted to the actual in-cylinder intake air amount klcyl(i).

If the value of the variable "i" becomes equal to the value M after repeated execution of step 720, the CPU 71 makes an affirmative determination (YES) in step 725, and proceeds to step 730 to acquire the actual throttle opening TA measured at the current point of time as an actual throttle opening TAact. In the following step 735, the CPU 71 determines the actual in-cylinder intake air amount from the actual throttle opening TAact, the engine speed NE detected at this point of time, the valve timing VT detected at this point of time, and the above-described intake air amount map. The CPU 71 stores the thus determined value in klcyl(M) as the latest actual in-cylinder intake air amount (of the last intake stroke) of the particular cylinder. The CPU 71 then proceeds to step 795 to finish the routine.

Thus, when the intake valve of a certain cylinder is closed and the intake stroke is finished, the CPU 71 calculates the actual in-cylinder intake air amount klcyl of the intake stroke of this cylinder that has just finished, based on at least the actual throttle opening TA (i.e., confirmed operating state quantity) measured at the time of closing of the intake valve, and successively stores the thus obtained amount klcyl at a location with a predetermined address in the RAM 73.

Calculation of Final Fuel Injection Amount finjfinal(k)

Next, the operation of the CPU 71 to determine the final fuel injection amount finjfinal(k) will be explained. The CPU 71 executes a control routine shown in the flowchart of FIG. 8 each time the crank angle of a particular cylinder becomes equal to 90° BTDC. While the CPU 71 executes the routine shown in FIG. 8 with respect to the particular cylinder, the CPU 71 executes the same routine as that of FIG. 8 independently with respect to the other cylinders, so as to control the fuel injection amount of the corresponding cylinder.

Initially, the CPU 71 starts the process in step 800, and proceeds to step 805 to read the actual in-cylinder intake air amount klcyl (=klcyl(k−1)) of the last intake stroke of the particular cylinder from the RAM 73. In this case, the value read as klcyl is the value of klcyl(M) stored in the RAM73.

Subsequently, the CPU 71 proceeds to step 810 to calculate the calculated in-cylinder fuel amount fc(k−1) for the last intake stroke, according to an expression that is based on the above-indicated expression (4) and described in the block of step 810 in FIG. 8. The CPU 71 then proceeds to step 815 to calculate the fuel deposition amounts fwp(k), fwv(k) before the coming intake stroke according to expressions that are based on the above-indicated expressions (5) and (6) and described in the block of step 815 in FIG. 8. In these expressions, the fuel left-over rates Pp, Pv and fuel deposition rates Rp, Rv accompanied by (klcyl), such as the fuel left-over rate Pp(klcyl), indicate that the fuel deposition or left-over rate is determined based on the actual in-cylinder intake air amount klcyl of the last intake stroke of the particular cylinder.

Figure 8:
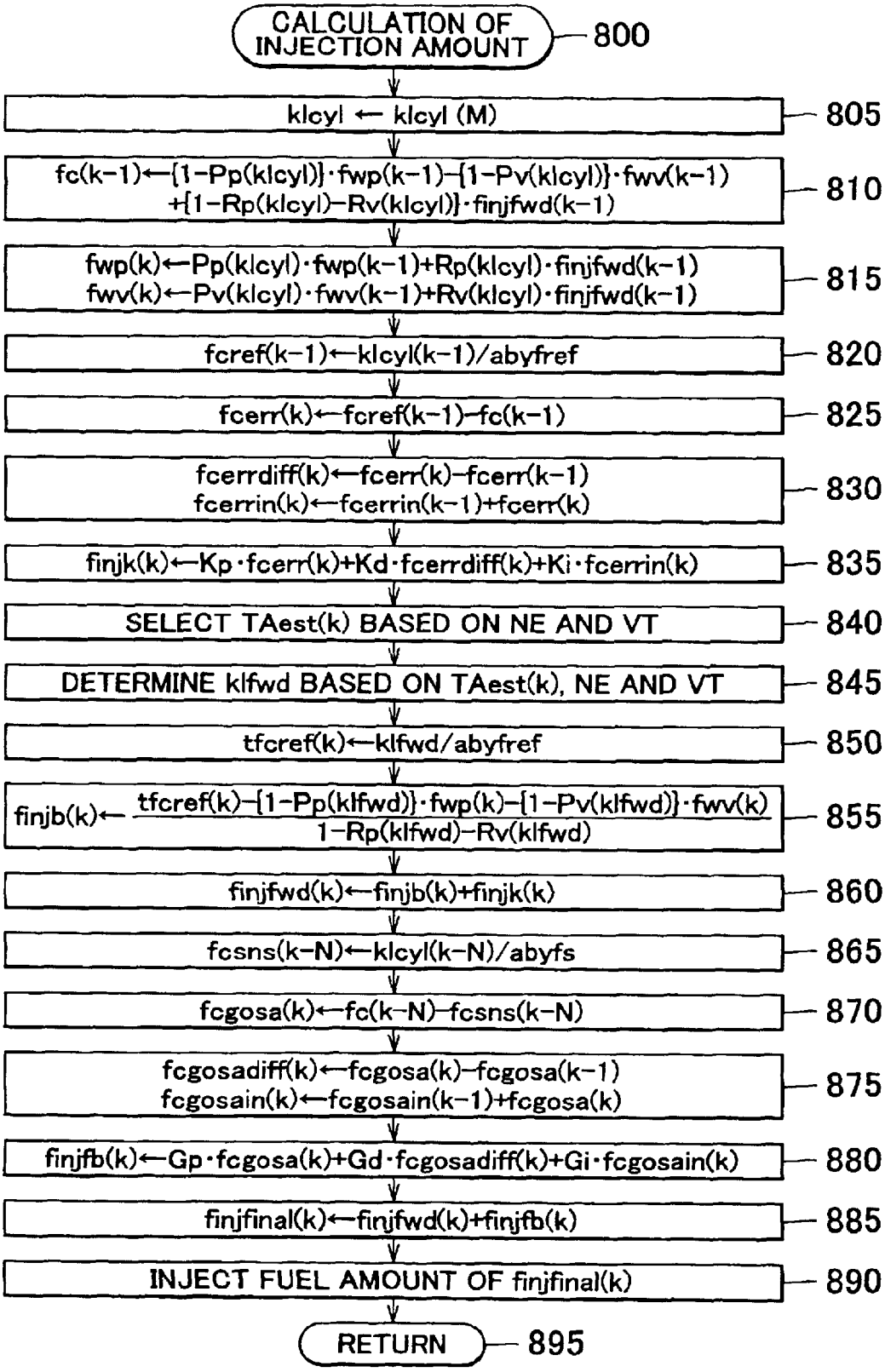
FIG. 8 is a flowchart showing a program executed by the CPU shown in FIG. 1 for calculating a final fuel injection amount.

Next, the CPU 71 calculates the feedforward target in-cylinder fuel amount fcref(k−1) for the last intake stroke in step 820 by dividing the actual in-cylinder intake air amount klcyl by the target air/fuel ratio abyfref, and calculates the fuel error amount fcerr(k) in step 825 according to an expression that is based on the above expression (7) and described in the block of step 825 in FIG. 8. The CPU 71 then calculates the differentiated error amount fcerrdiff(k) and the integrated error amount fcerrin(k) in step 830, according to expressions that are based on the above expressions (9) and (10) and described in the block of step 830, and calculates the feedforward correction amount finjk(k) in step 835, according to an expression that is based on the above expression (8) and described in the block of step 835.

Subsequently, the CPU 71 proceeds to step 840 to estimate the time it takes from the current point of time up to the completion of the coming intake stroke of the particular cylinder, based on the engine speed NE and the valve timing VT, and selects the predicted throttle opening TAest(k) to be established upon a lapse of the estimated time, from the predicted throttle openings stored in the RAM 73. In the following step 845, the predicted in-cylinder intake air amount klfwd of the particular cylinder in the coming intake stroke is calculated from the selected predicted throttle opening TAest(k), the engine speed NE and the valve timing VT detected at this point of time, and the intake air amount map as described above.

Subsequently, the CPU 71 proceeds to step 850 to calculate the tentative target in-cylinder fuel amount tfcref by dividing the predicted in-cylinder intake air amount klfwd by the target air/fuel ratio abyfref, and then proceeds to step 855 to calculate the basic fuel injection amount finjb(k) according to an expression that is based on the above-indicated expression (3) and described in the block of step 855 in FIG. 8. In this expressions, the fuel left-over rates Pp, Pv and fuel deposition rates Rp, Rv accompanied by (klfwd), such as the fuel left-over rate Pp(klfwd), indicate that the fuel deposition or left-over rate is determined at least based on the predicted in-cylinder intake air amount klfwd for the coming intake stroke of the particular cylinder. The CPU 71 then calculates the feedforward fuel injection amount finjfwd(k) in step 860 by adding the feedforward correction amount finjk(k) to the basic fuel injection amount finjb(k). With the above steps executed, the feedforward system finishes its correction process.

Next, the CPU 71 calculates the sensor detected in-cylinder fuel amount (fcsns(k−N)) in step 865 by dividing the actual in-cylinder intake air amount klcyl(k−N) for the intake stroke N cycles before the coming intake stroke by the detected air/fuel ratio abyfs, and calculates the feedback fuel error amount fcgosa(k) in step 870 according to an expression described in the block of step 870 in FIG. 8. The CPU 71 proceeds to step 875 to calculate the differentiated error amount fcgosadiff(k) and the integrated error amount fcgosain(k) according to expressions that are based on the above expressions (13) and (14) and are described in the block of step 875, and then proceeds to step 880 to calculate the feedback correction amount finjfb(k) according to an expression based on the above expression (12) and described in the block of step 880.

Subsequently, the CPU 71 calculates the final fuel injection amount finjfinal(k) in step 885 according to an expression that is based on the above expression (1) and is described in the block of step 885 in FIG. 8, and injects fuel in the final fuel injection amount finjfinal(k) from the injector 39 corresponding to the particular cylinder in step 890. The CPU 71 then proceeds to step 895 to finish the routine. In this manner, the final fuel injection amount finjfinal(k) is obtained by correcting the feedforward fuel injection amount finjfwd(k) by using the feedback correction amount finjfb(k). With the above-described step 865 through step 885 thus executed, the feedback system finishes its correction process.

As explained above, in the fuel injection amount control apparatus of the internal combustion engine as the embodiment of the invention, the feedforward system serves to accurately and immediately compensate for an excess or shortage of fuel due to a prediction/estimation error in the engine operating state quantity (e.g., the opening angle of the throttle valve), based on the actual operating state quantity, so that the air/fuel ratio can be accurately maintained at the target air/fuel ratio. In addition, the feedback system that utilizes the detected air/fuel ratio of the air/fuel ratio sensor 69 serves to surely reduce a steady-state deviation of the air/fuel ratio of an air-fuel mixture from the target air/fuel ratio due to changes in the properties of fuel, variations in the performance of the injectors 38 resulting from manufacturing errors, and the like. Furthermore, since the feedforward system and feedback system of the present fuel injection amount control apparatus are adapted to compensate for an excess or shortage of the fuel injection amount caused by different factors, the controls of the feedforward and feedback systems do not interfere with each other, and do not suffer from instability due to otherwise possible interference.

It is to be understood that the invention is not limited to details of the illustrated embodiment, but may be embodied with various modifications, changes or improvements which would occur to those skilled in the art without departing from the scope of the invention.

In the illustrated embodiment, the feedback correction amount (finjfb(k)) is calculated so that the deviation fcgosa (k) between the calculated in-cylinder fuel amount (fc(k–N)) and the sensor detected in-cylinder fuel amount (fcsns(k–N)) is reduced. However, the feedback correction amount (finjfb(k)) may be calculated in another manner. More specifically, the target air/fuel ratio for use in feedback control is calculated by dividing the actual in-cylinder intake air amount (klcyl(k–N)) of the intake stroke in which an air-fuel mixture that produces gas whose air/fuel ratio is detected by the air/fuel ratio sensor 69 was drawn into the cylinder, by the calculated in-cylinder fuel amount (fc(k–N)). Then, the feedback correction amount (finjfb(k)) is calculated by subjecting a deviation between the calculated target air/fuel ratio and the air/fuel ratio detected by the air/fuel ratio sensor 69 to a PID control process, so that the deviation is reduced.

Also, the predicted in-cylinder intake air amount may be calculated based on an air model that models the behavior of air in the intake system of the engine, as described in Japanese Laid-open Patent Publication No. 2001-41095. In the illustrated embodiment, when the internal combustion engine is in a steady-state operating state, such as when the amount of change of the throttle opening with time is small, the intake air amount in the coming intake stroke may be determined substantially based on the output of the air flow meter 61.

What is claimed is:

1. A fuel injection amount control apparatus of an internal combustion engine, comprising:

a predicted in-cylinder intake air amount calculating unit that predicts an operating state quantity of the engine to be established at a point of time ahead of a current point of time, and calculates a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

a basic fuel injection amount calculating unit that calculates a basic fuel injection amount for achieving a target air/fuel ratio, based on the predicted in-cylinder intake air amount calculated by the predicted in-cylinder intake air amount calculating unit and the target air/fuel ratio;

an actual in-cylinder intake air amount calculating unit that calculates an actual in-cylinder intake air amount at a point of time after the engine operating state quantity used by the predicted in-cylinder intake air amount calculating unit for calculating the predicted in-cylinder intake air amount with respect to an intake stroke one cycle before the particular intake stroke of the particular cylinder is confirmed, the actual in-cylinder intake air amount calculating unit calculating, as the actual in-cylinder intake air amount, an amount of intake air drawn into the particular cylinder during the intake stroke one cycle before the particular intake stroke, based on the confirmed actual operating state quantity;

a feedforward correction amount calculating unit that calculates a feedforward correction amount based on the predicted in-cylinder intake air amount for the intake stroke one cycle before the particular intake stroke and the actual in-cylinder intake air amount for the intake stroke one cycle before the particular intake stroke, the feedforward correction amount being determined so as to compensate for an excess or a shortage of the basic fuel injection amount for the intake stroke one cycle before the particular intake stroke, which excess or shortage is caused by a difference between the predicted in-cylinder intake air amount for the intake stroke one cycle before the particular intake stroke and the actual in-cylinder intake air amount for the intake stroke one cycle before the particular intake stroke;

a feedforward fuel injection amount calculating unit that calculates a feedforward fuel injection amount by correcting the basic fuel injection amount for the particular intake stroke of the particular cylinder by using the feedforward correction amount;

an air/fuel ratio sensor that detects an air/fuel ratio of an exhaust gas of the engine;

a feedback correction amount calculating unit that calculates a feedback correction amount for reducing a deviation between the air/fuel ratio detected by the air/fuel ratio sensor and an air/fuel ratio of an air-fuel mixture corresponding to the exhaust gas whose air/fuel ratio is detected by the air/fuel ratio sensor, based on the air/fuel ratio of the air-fuel mixture and the detected air/fuel ratio, the air/fuel ratio of the air-fuel mixture being determined based on the feedforward fuel injection amount calculated by the feedforward fuel injection amount calculating unit with respect to a past intake stroke of the particular cylinder during which the air-fuel mixture was introduced into the cylinder;

a final fuel injection amount calculating unit that calculates a final fuel injection amount by correcting the feedforward fuel injection amount calculated with respect to the particular intake stroke of the particular cylinder, by using the feedback correction amount; and a fuel injector that injects a fuel having the final fuel injection amount into the particular cylinder during the particular intake stroke.

2. The fuel injection amount control apparatus according to claim 1, wherein the basic fuel injection amount calculating unit calculates the basic fuel injection amount by using an inverse model of a fuel behavior model representing the behavior of a fuel deposited on a member that forms an intake passage of the engine.

3. A fuel injection amount control apparatus of an internal combustion engine, comprising:

a predicted in-cylinder intake air amount calculating unit that predicts an operating state quantity of the engine to be established at a point of time ahead of a current point of time, and calculates a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

a basic fuel injection amount calculating unit that calculates a basic fuel injection amount for achieving a target air/fuel ratio, based on the predicted in-cylinder intake air amount calculated by the predicted in-cylinder intake air amount calculating unit and the target air/fuel ratio;

a feedforward fuel injection amount calculating unit that calculates a feedforward fuel injection amount by correcting the basic fuel injection amount by using a feedforward correction amount;

a feedforward in-cylinder fuel amount calculating unit that calculates a calculated in-cylinder fuel amount that is an amount of fuel that is supposed to be supplied to the particular cylinder for an intake stroke one cycle before the particular intake stroke on the assumption that a fuel having the feedforward fuel injection amount calculated with respect to the intake stroke one cycle before the particular stroke is injected for the intake stroke one cycle before the particular stroke, the calculated in-cylinder fuel amount being calculated at a point of time later than the intake stroke one cycle before the particular intake stroke;

an actual in-cylinder intake air amount calculating unit that calculates an actual in-cylinder intake air amount that is an amount of intake air drawn into the particular cylinder during the intake stroke one cycle before the particular intake stroke, at a point of time later than a point of time at which the engine operating state quantity used by the predicted in-cylinder intake air amount calculating unit for calculating the predicted in-cylinder intake air amount with respect to the intake stroke one cycle before the particular intake stroke is confirmed, the actual in-cylinder intake air amount calculating unit calculating the actual in-cylinder intake air amount based on the confirmed actual operating state quantity;

a feedforward target in-cylinder fuel amount calculating unit that calculates a feedforward target in-cylinder fuel amount for achieving the target air/fuel ratio, based on the actual in-cylinder intake air amount and the target air/fuel ratio;

a feedforward correction amount calculating unit that calculates the feedforward correction amount based on the calculated in-cylinder fuel amount and the feedforward target in-cylinder fuel amount, the feedforward correction amount being determined so as to reduce a deviation between the calculated in-cylinder fuel amount and the feedforward target in-cylinder fuel amount;

an air/fuel ratio sensor that detects an air/fuel ratio of an exhaust gas of the engine;

a sensor detected in-cylinder fuel amount calculating unit that calculates a sensor detected in-cylinder fuel amount that is an amount of fuel actually supplied to the particular cylinder for an intake stroke a predetermined number of cycles before the particular intake stroke of the particular cylinder, based on the air/fuel ratio detected by the air/fuel ratio sensor and the actual in-cylinder intake air amount calculated by the actual in-cylinder intake air amount calculating unit with respect to the intake stroke the predetermined number of cycles before the particular intake stroke, wherein an air-fuel mixture introduced into the particular cylinder during the intake stroke the predetermined number of cycles before the particular intake stroke produces a gas whose air/fuel ratio is detected by the air/fuel ratio sensor;

a feedback correction amount calculating unit that calculates a feedback correction amount based on the calculated in-cylinder fuel amount and the sensor detected in-cylinder fuel amount, the feedback correction amount being determined so as to reduce a deviation between the calculated in-cylinder fuel amount calculated by the feedforward in-cylinder fuel amount calculating unit with respect to the intake stroke the predetermined number of cycles before the particular intake stroke, and the sensor detected in-cylinder fuel amount calculated by the sensor detected in-cylinder fuel amount calculating unit;

a final fuel injection amount calculating unit that calculates a final fuel injection amount by correcting the feedforward fuel injection amount calculated with respect to the particular intake stroke, by using the feedback correction amount; and a fuel injector that injects a fuel having the final fuel injection amount into the particular cylinder during the particular intake stroke.

4. The fuel injection amount control apparatus according to claim 3, wherein the feedforward in-cylinder fuel amount calculating unit calculates the calculated in-cylinder fuel amount by using a forward model of a fuel behavior model representing the behavior of a fuel deposited on a member that forms an intake passage of the engine.

5. The fuel injection amount control apparatus according to claim 4, wherein the basic fuel injection amount calculating unit calculates the basic fuel injection amount by using an inverse model of the fuel behavior model representing the behavior of the fuel deposited on the member that forms the intake passage of the engine.

6. The fuel injection amount control apparatus according to claim 3, wherein the basic fuel injection amount calculating unit calculates the basic fuel injection amount by using an inverse model of a fuel behavior model representing the behavior of a fuel deposited on a member that forms an intake passage of the engine.

7. A fuel injection amount control apparatus of an internal combustion engine, comprising:

a predicted in-cylinder intake air amount calculating unit that predicts an operating state quantity of the engine to be established at a point of time ahead of a current point of time, and calculates a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

a basic fuel injection amount calculating unit that calculates a basic fuel injection amount for achieving a target air/fuel ratio, based on the predicted in-cylinder intake air amount calculated by the predicted in-cylinder intake air amount calculating unit and the target air/fuel ratio;

a feedforward fuel injection amount calculating unit that calculates a feedforward fuel injection amount by correcting the basic fuel injection amount by using a feedforward correction amount;

a feedforward in-cylinder fuel amount calculating unit that calculates a calculated in-cylinder fuel amount that is an amount of fuel that is supposed to be supplied to the particular cylinder for an intake stroke one cycle before the particular intake stroke on the assumption that a fuel having the feedforward fuel injection amount calculated with respect to the intake stroke one cycle before the particular stroke is injected for the intake stroke one cycle before the particular stroke, the calculated in-cylinder fuel amount being calculated at a point of time later than the intake stroke one cycle before the particular intake stroke;

an actual in-cylinder intake air amount calculating unit that calculates an actual in-cylinder intake air amount that is an amount of intake air drawn into the particular cylinder during the intake stroke one cycle before the particular intake stroke, at a point of time later than a point of time at which the engine operating state quantity used by the predicted in-cylinder intake air amount calculating unit for calculating the predicted in-cylinder intake air amount with respect to the intake stroke one cycle before the particular intake stroke is confirmed, the actual in-cylinder intake air amount calculating unit calculating the actual in-cylinder intake air amount based on the confirmed actual operating state quantity;

a feedforward target in-cylinder fuel amount calculating unit that calculates a feedforward target in-cylinder fuel amount for achieving the target air/fuel ratio, based on the actual in-cylinder intake air amount and the target air/fuel ratio;

a feedforward correction amount calculating unit that calculates the feedforward correction amount based on the calculated in-cylinder fuel amount and the feedforward target in-cylinder fuel amount, the feedforward correction amount being determined so as to reduce a deviation between the calculated in-cylinder fuel amount and the feedforward target in-cylinder fuel amount;

an air/fuel ratio sensor that detects an air/fuel ratio of an exhaust gas of the engine;

a feedback correction amount calculating unit that calculates a feedback correction amount for reducing a deviation between a calculated air/fuel ratio and the air/fuel ratio detected by the air/fuel ratio sensor, based on the calculated air/fuel ratio and the detected air/fuel ratio, the calculated air/fuel ratio being determined based on the actual in-cylinder intake air amount calculated by the actual in-cylinder intake air amount calculating unit with respect to an intake stroke a predetermined number of cycles before the particular intake stroke of the particular cylinder, and the calculated in-cylinder fuel amount calculated by the feedforward in-cylinder fuel amount calculating unit with respect to the intake stroke the predetermined number of cycles before the particular intake stroke, wherein an air-fuel mixture introduced into the particular cylinder during the intake stroke the predetermined number of cycles before the particular intake stroke produces a gas whose air/fuel ratio is detected by the air/fuel ratio sensor;

a final fuel injection amount calculating unit that calculates a final fuel injection amount by correcting the feedforward fuel injection amount calculated with respect to the particular intake stroke of the particular cylinder, by using the feedback correction amount; and a fuel injector that injects a fuel having the final fuel injection amount into the particular cylinder during the particular intake stroke.

8. The fuel injection amount control apparatus according to claim 7, wherein the feedforward in-cylinder fuel amount calculating unit calculates the calculated in-cylinder fuel amount by using a forward model of a fuel behavior model representing the behavior of a fuel deposited on a member that forms an intake passage of the engine.

9. The fuel injection amount control apparatus according to claim 8, wherein the basic fuel injection amount calculating unit calculates the basic fuel injection amount by using an inverse model of the fuel behavior model representing the behavior of the fuel deposited on the member that forms the intake passage of the engine.

10. The fuel injection amount control apparatus according to claim 7, wherein the basic fuel injection amount calculating unit calculates the basic fuel injection amount by using an inverse model of a fuel behavior model representing the behavior of a fuel deposited on a member that forms an intake passage of the engine.

11. A method of controlling a fuel injection amount of an internal combustion engine, comprising the steps of:

predicting an operating state quantity of the engine to be established at a point of time ahead of a current point of time, and calculating a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

calculating a basic fuel injection amount for achieving a target air/fuel ratio, based on the predicted in-cylinder intake air amount and the target air/fuel ratio;

calculating an actual in-cylinder intake air amount at a point of time after the engine operating state quantity used for calculating the predicted in-cylinder intake air amount with respect to an intake stroke one cycle before the particular intake stroke of the particular cylinder is confirmed, the actual in-cylinder intake air amount being equal to an amount of intake air drawn into the particular cylinder during the intake stroke one cycle before the particular intake stroke and being calculated based on the confirmed actual operating state quantity;

calculating a feedforward correction amount based on the predicted in-cylinder intake air amount for the intake stroke one cycle before the particular intake stroke and the actual in-cylinder intake air amount for the intake stroke one cycle before the particular intake stroke, the feedforward correction amount being determined so as to compensate for an excess or a shortage of the basic fuel injection amount for the intake stroke one cycle before the particular intake stroke, which excess or shortage is caused by a difference between the predicted in-cylinder intake air amount for the intake stroke one cycle before the particular intake stroke and the actual in-cylinder intake air amount for the intake stroke one cycle before the particular intake stroke;

calculating a feedforward fuel injection amount by correcting the basic fuel injection amount for the particular intake stroke of the particular cylinder by using the feedforward correction amount;

detecting an air/fuel ratio of an exhaust gas of the engine;

calculating a feedback correction amount for reducing a deviation between the detected air/fuel ratio and an air/fuel ratio of an air-fuel mixture corresponding to the exhaust gas whose air/fuel ratio is detected, based on the air/fuel ratio of the air-fuel mixture and the detected air/fuel ratio, the air/fuel ratio of the air-fuel mixture being determined based on the feedforward fuel injection amount calculated with respect to a past intake stroke of the particular cylinder during which the air-fuel mixture was introduced into the cylinder;

calculating a final fuel injection amount by correcting the feedforward fuel injection amount calculated with respect to the particular intake stroke of the particular cylinder, by using the feedback correction amount; and injecting a fuel having the final fuel injection amount into the particular cylinder during the particular intake stroke.

12. The method according to claim 11, wherein the basic fuel injection amount is calculated by using an inverse model of a fuel behavior model representing the behavior of a fuel deposited on a member that forms an intake passage of the engine.

13. A method of controlling a fuel injection amount of an internal combustion engine, comprising the steps of:

predicting an operating state quantity of the engine to be established at a point of time ahead of a current point of time, and calculating a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

calculating a basic fuel injection amount for achieving a target air/fuel ratio, based on the predicted in-cylinder intake air amount and the target air/fuel ratio;

calculating a feedforward fuel injection amount by correcting the basic fuel injection amount by using a feedforward correction amount;

calculating a calculated in-cylinder fuel amount that is an amount of fuel that is supposed to be supplied to the particular cylinder for an intake stroke one cycle before the particular intake stroke on the assumption that a fuel having the feedforward fuel injection amount calculated with respect to the intake stroke one cycle before the particular stroke is injected for the intake stroke one cycle before the particular stroke, the calculated in-cylinder fuel amount being calculated at a point of time later than the intake stroke one cycle before the particular intake stroke;

calculating an actual in-cylinder intake air amount that is an amount of intake air drawn into the particular cylinder during the intake stroke one cycle before the particular intake stroke, at a point of time later than a point of time at which the engine operating state quantity used for calculating the predicted in-cylinder intake air amount with respect to the intake stroke one cycle before the particular intake stroke is confirmed, the actual in-cylinder intake air amount being calculated based on the confirmed actual operating state quantity;

calculating a feedforward target in-cylinder fuel amount for achieving the target air/fuel ratio, based on the actual in-cylinder intake air amount and the target air/fuel ratio;

calculating the feedforward correction amount based on the calculated in-cylinder fuel amount and the feedforward target in-cylinder fuel amount, the feedforward correction amount being determined so as to reduce a deviation between the calculated in-cylinder fuel amount and the feedforward target in-cylinder fuel amount;

detecting an air/fuel ratio of an exhaust gas of the engine;

calculating a sensor detected in-cylinder fuel amount that is an amount of fuel actually supplied to the particular cylinder for an intake stroke a predetermined number of cycles before the particular intake stroke of the particular cylinder, based on the detected air/fuel ratio and the actual in-cylinder intake air amount calculated with respect to the intake stroke the predetermined number of cycles before the particular intake stroke, wherein an air-fuel mixture introduced into the particular cylinder during the intake stroke the predetermined number of cycles before the particular intake stroke produces a gas whose air/fuel ratio is detected in the detecting step;

calculating a feedback correction amount based on the calculated in-cylinder fuel amount and the sensor detected in-cylinder fuel amount, the feedback correction amount being determined so as to reduce a deviation between the calculated in-cylinder fuel amount calculated with respect to the intake stroke the predetermined number of cycles before the particular intake stroke, and the sensor detected in-cylinder fuel amount;

calculating a final fuel injection amount by correcting the feedforward fuel injection amount calculated with respect to the particular intake stroke, by using the feedback correction amount; and injecting a fuel having the final fuel injection amount into the particular cylinder during the particular intake stroke.

14. The method according to claim 13, wherein the calculated in-cylinder fuel amount is calculated by using a forward model of a fuel behavior model representing the behavior of a fuel deposited on a member that forms an intake passage of the engine.

15. The fuel injection amount control apparatus according to claim 14, wherein the basic fuel injection amount is calculated by using an inverse model of the fuel behavior model representing the behavior of the fuel deposited on the member that forms the intake passage of the engine.

16. The method according to claim 13, wherein the basic fuel injection amount is calculated by using an inverse model of a fuel behavior model representing the behavior of a fuel deposited on a member that forms an intake passage of the engine.

17. A method of controlling a fuel injection amount of an internal combustion engine, comprising the steps of:

predicting an operating state quantity of the engine to be established at a point of time ahead of a current point of time, and calculating a predicted in-cylinder intake air amount that is an amount of intake air drawn into a particular cylinder of the engine during a particular intake stroke, based on the predicted engine operating state quantity, at a point of time before completion of the particular intake stroke of the particular cylinder;

calculating a basic fuel injection amount for achieving a target air/fuel ratio, based on the predicted in-cylinder intake air amount and the target air/fuel ratio;

calculating a feedforward fuel injection amount by correcting the basic fuel injection amount by using a feedforward correction amount;

calculating a calculated in-cylinder fuel amount that is an amount of fuel that is supposed to be supplied to the particular cylinder for an intake stroke one cycle before the particular intake stroke on the assumption that a fuel having the feedforward fuel injection amount calculated with respect to the intake stroke one cycle before the particular stroke is injected for the intake stroke one cycle before the particular stroke, the calculated in-cylinder fuel amount being calculated at a point of time later than the intake stroke one cycle before the particular intake stroke;

calculating an actual in-cylinder intake air amount that is an amount of intake air drawn into the particular cylinder during the intake stroke one cycle before the particular intake stroke, at a point of time later than a point of time at which the engine operating state quantity used for calculating the predicted in-cylinder intake air amount with respect to the intake stroke one cycle before the particular intake stroke is confirmed, the actual in-cylinder intake air amount being calculated based on the confirmed actual operating state quantity;

calculating a feedforward target in-cylinder fuel amount for achieving the target air/fuel ratio, based on the actual in-cylinder intake air amount and the target air/fuel ratio;

calculating the feedforward correction amount based on the calculated in-cylinder fuel amount and the feedforward target in-cylinder fuel amount, the feedforward correction amount being determined so as to reduce a deviation between the calculated in-cylinder fuel amount and the feedforward target in-cylinder fuel amount;

detecting an air/fuel ratio of an exhaust gas of the engine;

calculating a feedback correction amount for reducing a deviation between a calculated air/fuel ratio and the detected air/fuel ratio, based on the calculated air/fuel ratio and the detected air/fuel ratio, the calculated air/fuel ratio being determined based on the actual in-cylinder intake air amount calculated with respect to an intake stroke a predetermined number of cycles before the particular intake stroke of the particular cylinder, and the calculated in-cylinder fuel amount calculated with respect to the intake stroke the predetermined number of cycles before the particular intake stroke, wherein an air-fuel mixture introduced into the particular cylinder during the intake stroke the predetermined number of cycles before the particular intake stroke produces a gas whose air/fuel ratio is detected in the detecting step;

calculating a final fuel injection amount by correcting the feedforward fuel injection amount calculated with respect to the particular intake stroke of the particular cylinder, by using the feedback correction amount; and injecting a fuel having the final fuel injection amount into the particular cylinder during the particular intake stroke.

18. The method according to claim 17, wherein the calculated in-cylinder fuel amount is calculated by using a forward model of a fuel behavior model representing the behavior of a fuel deposited on a member that forms an intake passage of the engine.

19. The method according to claim 18, wherein the basic fuel injection amount is calculated by using an inverse model of the fuel behavior model representing the behavior of the fuel deposited on the member that forms the intake passage of the engine.

20. The method according to claim 17, wherein the basic fuel injection amount is calculated by using an inverse model of a fuel behavior model representing the behavior of a fuel deposited on a member that forms an intake passage of the engine.

* * * * *